US008826492B2

(12) United States Patent
Dyson et al.

(10) Patent No.: US 8,826,492 B2
(45) Date of Patent: Sep. 9, 2014

(54) SURFACE TREATING APPLIANCE

(75) Inventors: James Dyson, Malmesbury (GB); Thomas James Dunning Follows, Malmesbury (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 251 days.

(21) Appl. No.: 13/469,947

(22) Filed: May 11, 2012

(65) Prior Publication Data

US 2012/0284953 A1 Nov. 15, 2012

(30) Foreign Application Priority Data

May 11, 2011 (GB) ..... 1107776.5

(51) Int. Cl.
*A47L 9/14* (2006.01)

(52) U.S. Cl.
USPC ..... 15/353; 15/347

(58) Field of Classification Search
USPC ..... 15/347, 352, 353; 55/337, 345, 346, 55/349, DIG. 3
See application file for complete search history.

(56) References Cited

U.S. PATENT DOCUMENTS

| | | | | |
|---|---|---|---|---|
| 3,061,994 | A | 11/1962 | Mylting | |
| 3,425,192 | A | 2/1969 | Davis | |
| 3,543,931 | A | 12/1970 | Rastatter | |
| 4,373,228 | A | 2/1983 | Dyson | |
| 4,853,008 | A | 8/1989 | Dyson | |
| 4,863,500 | A | 9/1989 | Rombout et al. | |
| 6,607,572 | B2 | 8/2003 | Gammack et al. | |
| 7,874,040 | B2 * | 1/2011 | Follows et al. | 15/347 |
| 7,892,305 | B2 | 2/2011 | Hyun et al. | |
| 7,976,597 | B2 * | 7/2011 | Smith | 55/343 |
| 8,209,815 | B2 * | 7/2012 | Makarov et al. | 15/352 |
| 8,409,335 | B2 * | 4/2013 | Dyson et al. | 96/55 |
| 2002/0116907 | A1 | 8/2002 | Gammack et al. | |
| 2007/0209338 | A1 | 9/2007 | Conrad | |
| 2008/0172994 | A1 | 7/2008 | Courtney et al. | |

(Continued)

FOREIGN PATENT DOCUMENTS

| | | |
|---|---|---|
| CN | 201182569 | 1/2009 |
| CN | 101862165 | 10/2010 |

(Continued)

OTHER PUBLICATIONS

Search Report and Written Opinion mailed Aug. 24, 2012, directed to International Application No. PCT/GB2012/050873; 9 pages.

(Continued)

*Primary Examiner* — Dung Van Nguyen
(74) *Attorney, Agent, or Firm* — Morrison & Foerster LLP

(57) ABSTRACT

A surface treating appliance includes a first cyclonic separating unit including at least one first cyclone, a second cyclonic separating unit located downstream from the first cyclonic separating unit and including at least one second cyclone, and a third cyclonic separating unit located downstream from the second cyclonic separating unit and including a plurality of third cyclones arranged in parallel about an axis. Each third cyclone has a fluid inlet and a fluid outlet. The plurality of third cyclones are divided into at least a first set of third cyclones and a second set of third cyclones, with the fluid inlets of the first set of third cyclones being arranged in a first group and the fluid inlets of the second set of third cyclones being arranged in a second group spaced along said axis from the first group.

17 Claims, 14 Drawing Sheets

(56) References Cited

U.S. PATENT DOCUMENTS

| | | | |
|---|---|---|---|
| 2009/0100810 | A1 | 4/2009 | Smith |
| 2010/0242219 | A1 | 9/2010 | Dyson et al. |
| 2010/0313531 | A1 | 12/2010 | Conrad |
| 2012/0284952 | A1 | 11/2012 | Horne |
| 2012/0284954 | A1 | 11/2012 | Horne |
| 2012/0284956 | A1 | 11/2012 | Follows |
| 2012/0284957 | A1 | 11/2012 | Follows |
| 2012/0284958 | A1 | 11/2012 | Dyson |
| 2012/0284959 | A1 | 11/2012 | Gammack |
| 2012/0284960 | A1 | 11/2012 | Sutton et al. |

FOREIGN PATENT DOCUMENTS

| | | |
|---|---|---|
| CN | 201958793 | 9/2011 |
| EP | 1 268 076 | 1/2003 |
| EP | 1 969 986 | 9/2008 |
| EP | 2 052 659 | 4/2009 |
| GB | 2 360 719 | 10/2001 |
| GB | 2 399 780 | 9/2004 |
| GB | 2 424 603 | 10/2006 |
| GB | 2 424 606 | 10/2006 |
| GB | 2 426 473 | 11/2006 |
| GB | 2 426 726 | 12/2006 |
| GB | 2 436 281 | 9/2007 |
| GB | 2 449 605 | 11/2008 |
| GB | 2 453 760 | 4/2009 |
| GB | 2 453 761 | 4/2009 |
| GB | 2 454 227 | 5/2009 |
| GB | 2469047 | 10/2010 |
| GB | 2469057 | 10/2010 |
| GB | 2472099 | 1/2011 |
| GB | 2475312 | 5/2011 |
| GB | 2475313 | 5/2011 |
| JP | 43-18948 | 8/1968 |
| JP | 6-63453 | 3/1994 |
| JP | 2006-272314 | 10/2006 |
| JP | 2008-541815 | 11/2008 |
| JP | 2008-541816 | 11/2008 |
| JP | 2010-201167 | 9/2010 |
| JP | 2011-41766 | 3/2011 |
| KR | 10-2009-0070450 | 7/2009 |
| WO | WO-2006/125945 | 11/2006 |
| WO | WO-2006/125946 | 11/2006 |
| WO | WO-2011/058365 | 5/2011 |

OTHER PUBLICATIONS

Home, U.S. Office Action mailed Aug. 14, 2013, directed to U.S. Appl. No. 13/469,949; 8 pages.

Home, U.S. Office Action mailed Aug. 14, 2013, directed to U.S. Appl. No. 13/469,910; 8 pages.

Search Report dated Sep. 9, 2011, directed to GB Patent Application No. 1107776.5; 1 page.

* cited by examiner

B - B

D - D

E - E

SURFACE TREATING APPLIANCE

REFERENCE TO RELATED APPLICATIONS

This application claims the priority of United Kingdom Application No. 1107776.5, filed May 11, 2011, the entire contents of which are incorporated herein by reference.

FIELD OF THE INVENTION

The present invention relates to a surface treating appliance. In its preferred embodiment, the appliance is in the form of an upright vacuum cleaner.

BACKGROUND OF THE INVENTION

Vacuum cleaners which utilize cyclonic separating apparatus are well known. Examples of such vacuum cleaners are shown in U.S. Pat. No. 4,373,228, U.S. Pat. No. 3,425,192, U.S. Pat. No. 6,607,572 and EP 1268076. The separating apparatus comprises first and second cyclonic separating units through which an incoming air passes sequentially. This allows the larger dirt and debris to be extracted from the airflow in the first separating unit, enabling the second cyclone to operate under optimum conditions and so effectively to remove very fine particles in an efficient manner.

In some cases, the second cyclonic separating unit includes a plurality of cyclones arranged in parallel. These cyclones are usually arranged in a ring extending about the longitudinal axis of the separating apparatus. Through providing a plurality of relatively small cyclones in parallel instead of a single, relatively large cyclone, the separation efficiency of the separating unit, that is, the ability of the separating unit to separate entrained particles from an air flow, can be increased. This is due to an increase in the centrifugal forces generated within the cyclones which cause dust particles to be thrown from the air flow.

Increasing the number of parallel cyclones can further increase the separation efficiency, or pressure efficiency, of the separating unit for the same overall pressure resistance. However, when the cyclones are arranged in a ring this can increase the external diameter of the separating unit, which in turn can undesirably increase the size of the separating apparatus. While this size increase can be ameliorated through reducing the size of the individual cyclones, the extent to which the cyclones can be reduced in size is limited. Very small cyclones can become rapidly blocked and can be detrimental to the rate of the air flow through the vacuum cleaner, and thus its cleaning efficiency.

SUMMARY OF THE INVENTION

In a first aspect, the present invention provides a surface treating appliance comprising a first cyclonic separating unit including at least one first cyclone, a second cyclonic separating unit located downstream from the first cyclonic separating unit and including at least one second cyclone, and a third cyclonic separating unit located downstream from the second cyclonic separating unit and including a plurality of third cyclones arranged in parallel about an axis, each third cyclone comprising a fluid inlet and a fluid outlet, the plurality of third cyclones being divided into at least a first set of third cyclones and a second set of third cyclones, the fluid inlets of the first set of third cyclones being arranged in a first group and the fluid inlets of the second set of third cyclones being arranged in a second group spaced along said axis from the first group.

The present invention thus provides a surface treating appliance having separating apparatus comprising at least three stages of cyclonic separation, and in which the cyclones of the third cyclonic separating unit are separated into sets. Separating the cyclones of the third cyclonic separating unit into first and second sets which are each arranged about a common axis and have fluid inlets grouped together can allow the sets of third cyclones to be spaced along the axis. This can enable both the number and the size of the third cyclones to be chosen for optimized separation efficiency and cleaning efficiency within the dimensional constraints for the separating apparatus.

Each set may contain the same number of third cyclones. For example, if the optimum number of cyclones for the third cyclonic separating unit is twenty four then these cyclones may be arranged in two sets of twelve cyclones, three sets of eight cyclones or four sets of six cyclones depending on the maximum diameter for the separating apparatus and/or the maximum height for the separating apparatus. Alternatively, each set may contain a respective different number of cyclones. For example, if the optimum number of cyclones for the third cyclonic separating unit is thirty six then these cyclones may be arranged in a first set of eighteen cyclones, a second set of twelve cyclones and a third set of six cyclones.

The appliance preferably comprises a first dust collector for receiving dust from the first cyclonic separating unit, a second dust collector for receiving dust from the second cyclonic separating unit, and a third dust collector for receiving dust from the third cyclonic separating unit. The provision of a common dust collector for each of the sets of third cyclones can facilitate emptying and cleaning of the third cyclonic separating unit. The first dust collector may extend about the second dust collector and the third dust collector. The second dust collector may extend about the third dust collector. For example, the third dust collector may have a substantially cylindrical shape, and each of the first and second dust collectors may have an annular shape which extends about the cylindrical first dust collector. Alternatively, the third dust collector may also be annular in shape. The dust collectors are preferably arranged to be emptied simultaneously.

The second dust collector preferably has a larger volume than each of the first and third dust collectors. The volume of the second dust collector is preferably greater than the sum of the volumes of the first and third dust collectors.

The fluid inlets of the sets of third cyclones may be arranged in one of a number of different arrangements. For example, the inlets may be arranged in helical arrangements extending about the axis, so that the fluid inlets are located at different axial positions as measured along said axis. Alternatively, the first group of fluid inlets may be arranged in a first annular arrangement, and the second group of fluid inlets may be arranged in a second annular arrangement spaced along said axis from the first annular arrangement. The annular arrangements may be of substantially the same size, or they may be of respective different sizes. Each arrangement of fluid inlets may be substantially orthogonal to said axis. Within each arrangement, the fluid inlets may be inclined relative to said axis so that the fluid inlets are in a generally frusto-conical arrangement extending about said axis, or they may be substantially orthogonal to said axis, depending on the angle of inclination of the cyclones relative to said axis.

Within each set, the third cyclones are preferably substantially equidistant from said axis. Alternatively, or additionally, the third cyclones may be substantially equidistantly, or equi-angularly, spaced about said axis.

The axis is preferably a longitudinal axis of the first cyclonic separating unit. The first cyclonic separating unit preferably comprises a single first cyclone, which is preferably substantially cylindrical. The first cyclonic separating unit preferably at least partially surrounds the second and third dust collectors.

The first set of third cyclones is preferably located above at least part of the second set of third cyclones. The first set of third cyclones may be arranged around part of the second set of third cyclones, so that the first set of third cyclones overlaps circumferentially part, preferably an upper part, of the second set of third cyclones. This can allow the first and second sets of third cyclones to be brought closer together, reducing the overall height of the separating apparatus. At least part of the outside wall of each of the cyclones of the first set of third cyclones may form part of the external surface of the surface treating appliance. The incorporation of at least part of the outer walls of the tapering bodies of the cyclones into the external surface of the appliance allows the overall volume of the appliance to be kept to a minimum.

The radius of the first annular arrangement of the first group of fluid inlets may be greater than the radius of the second annular arrangement of the second group of fluid inlets. In this case, the first set of third cyclones may comprise a greater number of cyclones than the second set of third cyclones.

Each of the cyclones of the third cyclonic separating unit preferably has a tapering body, which is preferably frusto-conical in shape.

Each third cyclone has a longitudinal axis, and the third cyclones are preferably arranged so that the longitudinal axes of at least the first set of third cyclones approach one another. Similarly, the second set of third cyclones is preferably arranged so that longitudinal axes of the cyclones approach one another. In either case, the longitudinal axes of the third cyclones preferably intersect the axis about which the cyclones are arranged, which is preferably the longitudinal axis of the first cyclonic separating unit.

The longitudinal axes of the cyclones of the first set of third cyclones preferably intersect said axis at the same angle. However, the longitudinal axes of the cyclones of the first set of third cyclones may intersect said axis at the two or more different angles. Similarly, the longitudinal axes of the cyclones of the second set of third cyclones preferably intersect said axis at the same angle, but again the longitudinal axes of the cyclones of the second set of third cyclones may intersect said axis at the two or more different angles.

The angle at which the longitudinal axes of the first set of third cyclones intersect said axis may be substantially the same as the angle at which the longitudinal axes of the second set of third cyclones intersect said axis. Alternatively, the angle at which the longitudinal axes of the first set of third cyclones intersect said axis may be different from the angle at which the longitudinal axes of the second set of third cyclones intersect said axis. For example, the angle at which the longitudinal axes of the first set of third cyclones intersect said axis may be greater than the angle at which the longitudinal axes of the second set of third cyclones intersect said axis. Increasing the angle at which one of the sets of cyclones is inclined to the axis can decrease the overall height of the separating apparatus.

In addition to the first and second sets of third cyclones, the third cyclonic separating unit may comprise a third set of third cyclones. The fluid inlets of the third set of third cyclones may be arranged in a third group which is spaced along said axis from the first group and the second group. Again, the inlets of the third set of third cyclones may be arranged in a helical arrangement extending about the axis. Preferably though, the third group of fluid inlets is generally arranged in a third annular arrangement, which is spaced along said axis from the first and second annular arrangements. As above, the arrangement of the fluid inlets may be considered to be orthogonal to said axis. Within this third arrangement, the fluid inlets may be inclined relative to said axis so that the fluid inlets are in a generally frusto-conical arrangement extending about said axis, or they may be substantially orthogonal to said axis, depending on the angle of inclination of the cyclones relative to said axis.

The second set of third cyclones is preferably located above at least part of the third set of third cyclones. To reduce the height of the separating apparatus, the second set of third cyclones may be arranged around part of the third set of third cyclones, so that the second set of third cyclones overlaps circumferentially part, preferably an upper part, of the third set of third cyclones. The first set of third cyclones may also extend about part of the third set of third cyclones so that this first set of third cyclones overlaps circumferentially at least part of each of the second and third sets of cyclones. This can further allow the third cyclones to be brought closer together, reducing the overall height of the separating apparatus.

The radius of the second annular arrangement of the second group of fluid inlets may be greater than the radius of the third annular arrangement of the third group of fluid inlets. In this case, the second set of third cyclones may comprise a greater number of cyclones than the third set of third cyclones.

As mentioned above, each of the cyclones of the third cyclonic separating unit preferably has a tapering body, which is preferably frusto-conical in shape. The cyclones of the third set of third cyclones may be arranged so that their longitudinal axes approach one another. Alternatively, the cyclones of the third set of third cyclones may be arranged so that their longitudinal axes are substantially parallel. These longitudinal axes may be arranged so that they are substantially parallel to the axis about which the third cyclones are arranged.

The second cyclonic separating unit may comprise a single second cyclone. Alternatively, the second cyclonic separating unit may comprise a plurality of second cyclones arranged in parallel. The plurality of second cyclones may be arranged about the axis about which the third cyclones are arranged.

The plurality of second cyclones may be arranged at least partially above the at least one first cyclone of the first cyclonic separating unit. The plurality of second cyclones may be arranged at least partially beneath at least some the plurality of third cyclones. The plurality of second cyclones may be arranged about at least some of the third cyclones. For example, the plurality of second cyclones may be arranged about part of one or more of the sets of third cyclones. The plurality of second cyclones may extend about the first set of third cyclones, with the first set of third cyclones extending about the second set of third cyclones. The plurality of second cyclones may also extend about the second set of third cyclones, with the plurality of second cyclones overlapping the first and second sets of third cyclones by respective different amounts.

The arrangement of the second cyclones about said axis may be substantially the same as the arrangement of the first set of third cyclones about said axis. The plurality of second cyclones and the first set of third cyclones may be equidistant from said axis. Each second cyclone may be located immediately beneath a respective cyclone of the first set of third cyclones. In other words, each second cyclone comprises a fluid inlet and a fluid outlet, and the fluid inlets of the second cyclones may be arranged in a second cyclone inlet group which is spaced along the axis from at least the first group. Alternatively, the plurality of second cyclones may be angularly offset about said axis relative to the first set of third cyclones. At least part of the outside wall of each of the second cyclones may form part of the external surface of the surface treating appliance The number of third cyclones may be greater than the number of second cyclones. The second cyclonic separating unit and the first set of third cyclones may comprise the same number of cyclones.

Each second cyclone may be substantially the same as each of the third cyclones. Alternatively, each second cyclone may be larger or smaller than each of the third cyclones. Each of the cyclones of the second cyclonic separating unit may have a tapering body, which is preferably frusto-conical in shape. Each second cyclone may have a longitudinal axis, with the second cyclones arranged so that the longitudinal axes of the second cyclones approach one another. The longitudinal axes of the second cyclones may intersect the axis about which the cyclones are arranged at the same angle as the longitudinal axes of the first set of third cyclones. In other words, the plurality of second cyclones and the first set of third cyclones may be arranged at a first orientation to the axis, and the second set of third cyclones may be arranged at a second orientation, different from the first orientation, to the axis.

Each second cyclone may comprise a flexible portion. Providing each second cyclone with a flexible portion may help to prevent dirt from building up inside the cyclone during use of the surface treating appliance. Each second cyclone may comprise a tapering body having a relatively wide portion and a relatively narrow portion, with the relatively narrow portion of each second cyclone being flexible. The relatively wide portion preferably has a greater stiffness that the relatively narrow portion. For example, the relatively wide portion of the tapering body may be formed from material having a greater stiffness than the relatively narrow portion of the tapering body. The relatively wide portion may be formed from plastics or metal material, for example poly propylene, ABS or aluminium, whereas the relatively narrow portion may be formed from a thermoplastic elastomer, TPU, silicon rubber or natural rubber. Alternatively, the relatively wide portion of the tapering body may have a greater thickness than the relatively narrow portion of the tapering body. The relatively narrow portion may be a tip of the cyclone. The tip can vibrate during use of the appliance, which can the effect of breaking up dust deposits before agglomeration thereof results in cyclone blockage.

At least the first set of third cyclones may also comprise such a flexible portion.

The appliance may comprise a first manifold for receiving the fluid from the first cyclonic separating unit, and for conveying the fluid to the second cyclonic separating unit. In this case, each of the fluid inlets of the second cyclones is arranged to receive fluid from the first manifold. The appliance preferably comprises a shroud forming an outlet from the first cyclonic separating unit, the shroud comprising a wall having a multiplicity of through-holes, and wherein the first manifold is arranged to received fluid from the shroud. The first manifold may comprise a plurality of inlet ducts for receiving fluid from the shroud. The inlet ducts may be angularly spaced about said axis.

The appliance may comprise a second manifold for receiving fluid from the second cyclonic separating unit, and for conveying the fluid to the third cyclones of the third cyclonic separating unit. In this case, each of the fluid inlets of the third cyclones is arranged to receive fluid from the second manifold. The second manifold is preferably located above the first manifold.

The appliance may comprise an outlet chamber for receiving fluid from the fluid outlets of the third cyclones. The third set of third cyclones is preferably arranged beneath the outlet chamber, whereas the first and second sets of third cyclones are preferably arranged about the outlet chamber. Locating a third set of third cyclones beneath the outlet chamber can further allow the number of cyclones of the third cyclonic separating unit to be maximized. In this case, the second manifold may extend about and beneath the outlet chamber to convey the fluid flow to the cyclones of the third cyclonic separating unit.

The outlet chamber preferably comprises a biased, or spring-loaded, coupling member moveable relative to the cyclonic separating units for engaging an outlet duct for receiving the fluid flow from the separating apparatus, the coupling member comprising a fluid outlet through which the fluid flow is exhausted from the separating apparatus. This can enable an air tight seal to be maintained between the separating apparatus and the outlet duct by biasing only a portion of the separating apparatus, namely the coupling member, towards the outlet duct.

The cyclonic separating units preferably form part of a separating apparatus, which is preferably removably mounted on a main body of the appliance.

The appliance preferably comprises a motor-driven fan unit for drawing the air flow through the appliance. The provision of a separating apparatus with three stages of cyclonic separation, and in which the second and third cyclonic separating units each comprise a plurality of cyclones arranged in parallel, can enable the separation efficiency of the separating apparatus to be sufficiently high as to enable the fluid flow to pass from the third cyclonic separating unit directly to the fan unit, that is, without passing through a filter assembly located upstream from the fan unit.

The surface treating appliance is preferably in the form of a vacuum cleaning appliance. The term "surface treating appliance" is intended to have a broad meaning, and includes a wide range of machines having a head for travelling over a surface to clean or treat the surface in some manner. It includes, inter alia, machines which apply suction to the surface so as to draw material from it, such as vacuum cleaners (dry, wet and wet/dry), as well as machines which apply material to the surface, such as polishing/waxing machines, pressure washing machines, ground marking machines and shampooing machines. It also includes lawn mowers and other cutting machines.

In a second aspect, the present invention also provides cyclonic separating apparatus comprising a first cyclonic separating unit including at least one first cyclone, a second cyclonic separating unit located downstream from the first cyclonic separating unit and including at least one second cyclone, and a third cyclonic separating unit located downstream from the second cyclonic separating unit and including a plurality of third cyclones arranged in parallel about an axis, each third cyclone comprising a fluid inlet and a fluid outlet, the plurality of third cyclones being divided into at least a first set of third cyclones and a second set of third cyclones, the fluid inlets of the first set of third cyclones being arranged in a first group and the fluid inlets of the second set of third cyclones being arranged in a second group spaced along said axis from the first group.

Features described above in connection with the first aspect of the invention are equally applicable to the second aspect of the invention, and vice versa.

BRIEF DESCRIPTION OF THE DRAWINGS

Preferred features of the invention will now be described, by way of example only, with reference to the accompanying drawings, in which.

DETAILED DESCRIPTION OF THE INVENTION

Figure 1:
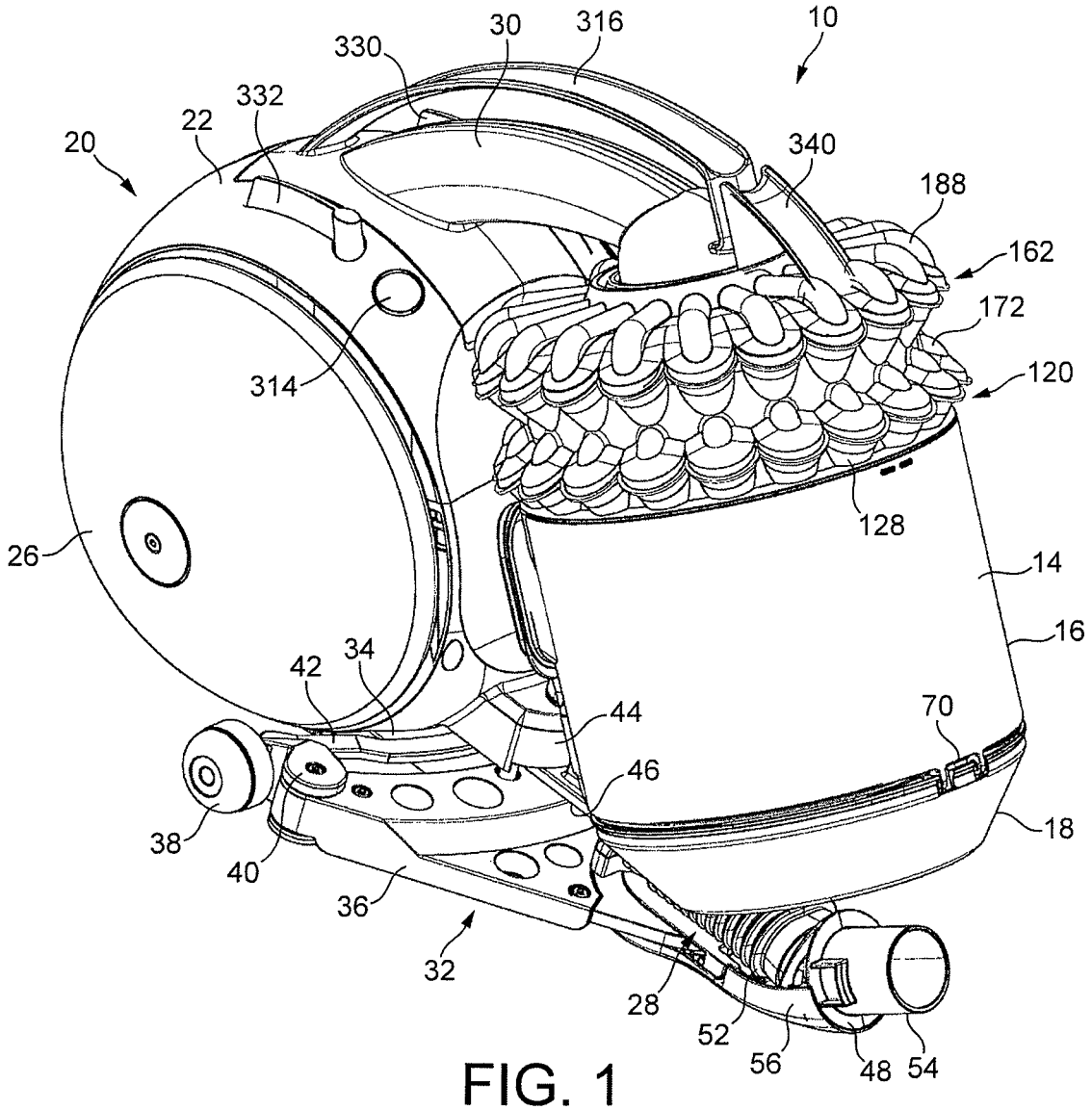
FIG. 1 is a front perspective view, from above, of a vacuum cleaner.
Figure 2A:
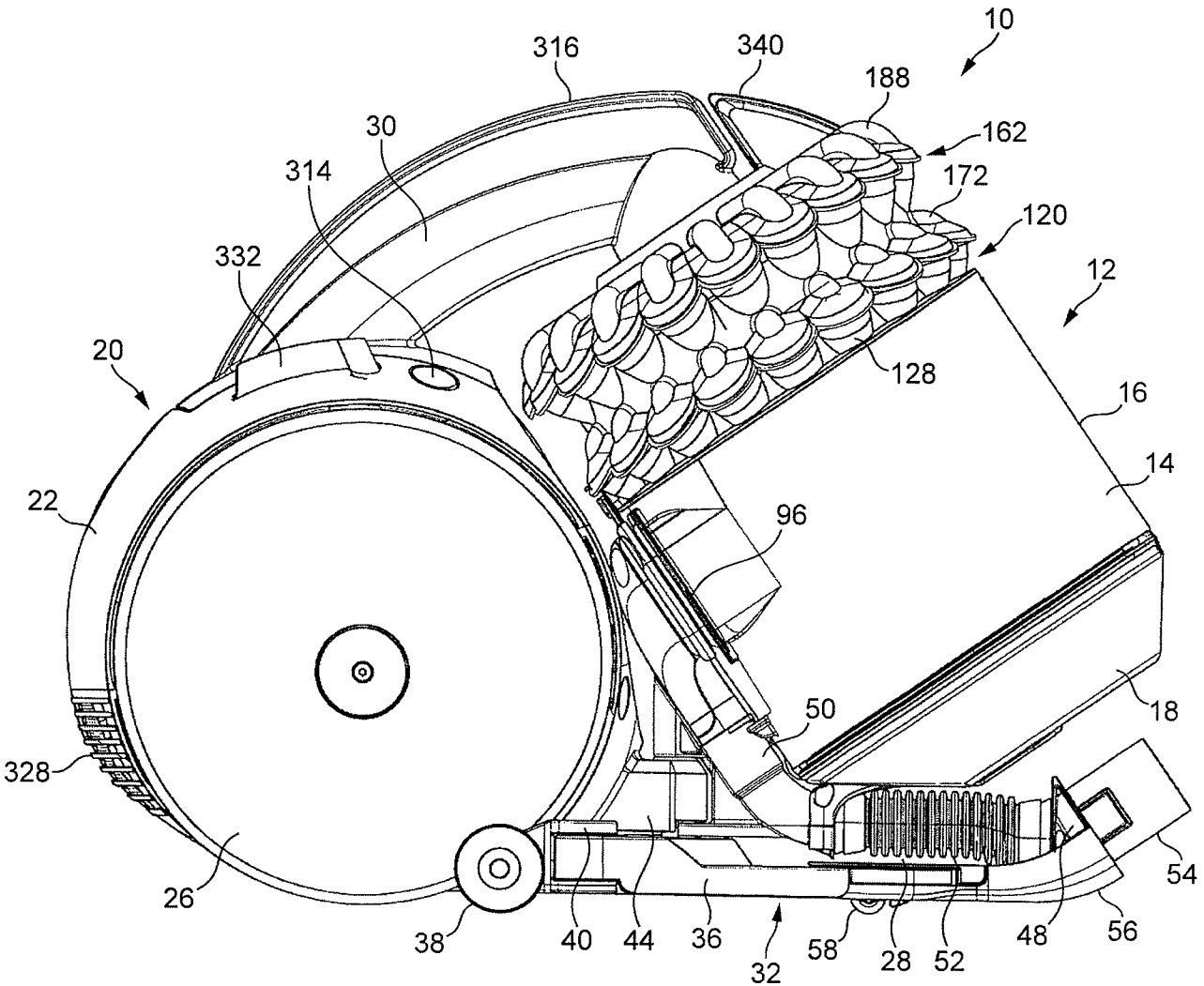
FIG. 2(*a*) is a side view of the vacuum cleaner, with a duct of the vacuum cleaner in a lowered position, and FIG. 2(*b*) is a side view of the vacuum cleaner with the duct in a raised position.
Figure 2B:
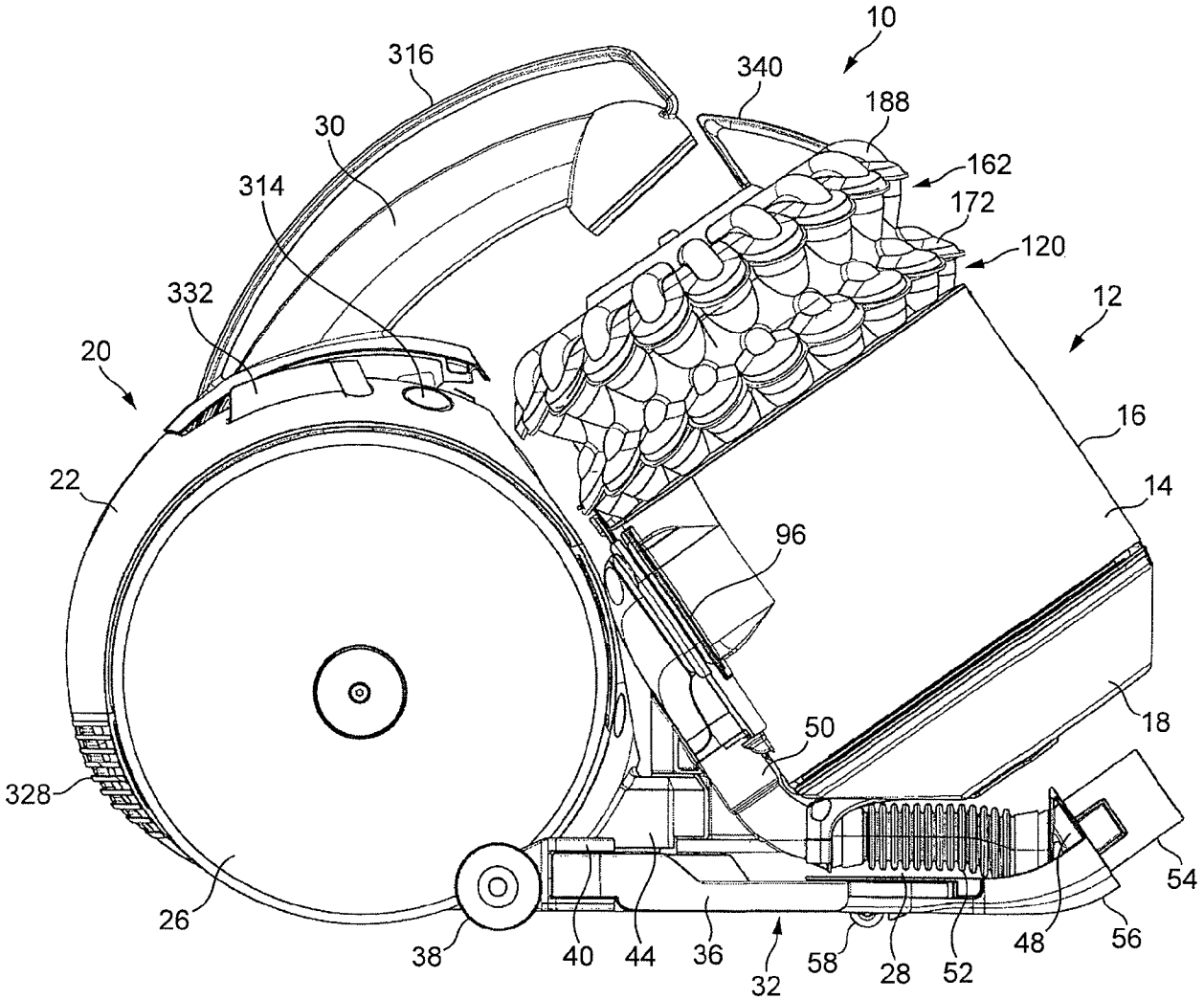
Figure 3:
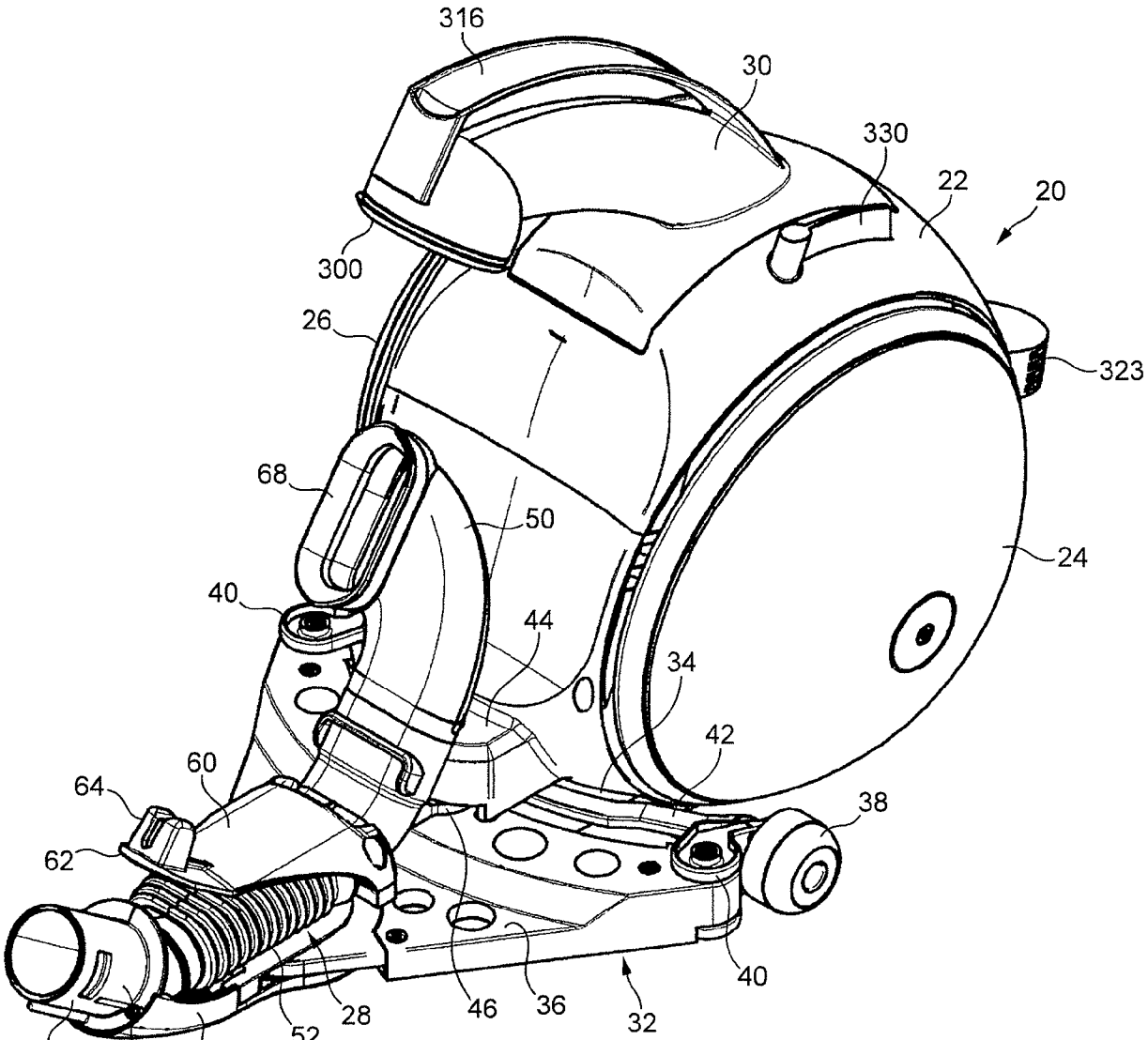
FIG. 3 is a front perspective view, from above, of the vacuum cleaner, with a separating apparatus of the vacuum cleaner removed.

FIGS. 1 and 2(*a*) illustrate external views of a surface treating appliance in the form of a vacuum cleaner 10. The vacuum cleaner 10 is of the cylinder, or canister, type. In overview, the vacuum cleaner 10 comprises separating apparatus 12 for separating dirt and dust from an air flow. The separating apparatus 12 is in the form of cyclonic separating apparatus, and comprises an outer bin 14 having an outer wall 16 which is substantially cylindrical in shape. The lower end of the outer bin 14 is closed by a base 18 which is pivotably attached to the outer wall 16. A motor-driven fan unit for generating suction for drawing dirt laden air into the separating apparatus 12 is housed within a rolling assembly 20 located behind the separating apparatus 12. With reference also to FIG. 3, the rolling assembly 20 comprises a main body 22 and two wheels 24, 26 rotatably connected to the main body 22 for engaging a floor surface. An inlet duct 28 located beneath the separating apparatus 12 conveys dirt-bearing air into the separating apparatus 12, and an outlet duct 30 conveys air exhausted from the separating apparatus 12 into the rolling assembly 20.

A chassis 32 is connected to the main body 22 of the rolling assembly 20. The chassis 32 is generally in the shape of an arrow, and comprises a shaft 34 connected at the rear end thereof to the main body 22 of the rolling assembly 20, and a generally triangular head 36. The inclination of the side walls of the head 36 of the chassis 32 can assist in maneuvering the vacuum cleaner 10 around corners, furniture or other items upstanding from the floor surface, as upon contact with such an item these side walls tend to slide against the upstanding item to guide the rolling assembly 20 around the upstanding item.

A pair of wheel assemblies 38 for engaging the floor surface is connected to the head 36 of the chassis 32. Each wheel assembly 38 is connected to a respective corner of the head 36 by a steering arm 40 shaped so that the wheel assemblies 38 are located behind the head 36 of the chassis 32, but contact a floor surface in front of the wheels 24, 26 of the rolling assembly 20. The wheel assemblies 38 thus support the rolling assembly 20 as it is maneuvered over a floor surface, restricting rotation of the rolling assembly 20 about an axis which is orthogonal to the rotational axes of the wheel assemblies 38, and substantially parallel to the floor surface over which the vacuum cleaner 10 is being maneuvered. The distance between the points of contact of the wheel assemblies 38 with the floor surface is greater than that between the points of contact of the wheels 24, 26 of the rolling assembly 20 with that floor surface. In this example, each steering arm 40 is connected at a first end thereof to the chassis 32 for pivoting movement about a respective hub axis. Each hub axis is substantially orthogonal to the axes of rotation of the wheel assemblies 38. The second end of each steering arm 40 is connected to a respective wheel assembly 38 so that the wheel assembly 38 is free to rotate as the vacuum cleaner 10 is moved over the floor surface.

The movement of the steering arms 40, and thus the wheel assemblies 38, relative to the chassis 32 is controlled by an elongate track control arm 42. Each end of the track control arm 42 is connected to the second end of a respective steering arm 40 so that movement of the track control arm 42 relative to the chassis 32 causes each steering arm 40 to pivot about its hub axis. This in turn causes each wheel assembly 38 to orbit about its respective corner of the chassis 32 to change the direction of the movement of the vacuum cleaner 10 over the floor surface.

The movement of the track control arm 42 relative to the chassis 32 is effected by movement of the inlet duct 28 relative to the chassis 32. With reference also to FIG. 3, the track control arm 42 passes beneath a duct support 44 extending forwardly from, and preferably integral with, the body 22 of the rolling assembly 20. Alternatively, the duct support 44 may be connected to the chassis 32. The inlet duct 28 is pivotably connected to the duct support 44 for movement about an axis which is substantially orthogonal to the axes of rotation of the wheel assemblies 38. The inlet duct 28 comprises a rearwardly extending arm 46 which passes beneath the duct support 44 to engage the track control arm 42 so that the track control arm 42 moves relative to the chassis 32 as the arm 46 moves with the inlet duct 28.

The inlet duct 28 comprises a relatively rigid inlet section 48, a relatively rigid outlet section 50 and a relatively flexible hose 52 extending between the inlet section 48 and the outlet section 50. The inlet section 48 comprises a coupling 54 for connection to a wand and hose assembly (not shown) for conveying a dirt-bearing air flow to the inlet duct 28. The wand and hose assembly is connected to a cleaner head (not shown) comprising a suction opening through which a dirt-bearing air flow is drawn into the vacuum cleaner 10. The inlet section 48 is connected to, and supported by, a yoke 56. The yoke 56 comprises a floor engaging rolling element 58 for supporting the yoke 56 on the floor surface. The rear section of the yoke 56 is connected to the chassis 32 for pivoting movement about a yoke pivot axis, which is spaced from, and substantially parallel to, the pivot axis of the inlet duct 28. The chassis 32 is shaped to restrict the pivoting movement of the yoke 56 relative to the chassis 32 to within a range of around ±65°.

The outlet section 50 of the inlet duct 28 is pivotably connected to the duct support 44, and extends along the outer surface of the separating apparatus 12. To maneuver the vacuum cleaner 10 over the floor surface, the user pulls the hose of the hose and wand assembly connected to the coupling 54 to drag the vacuum cleaner 10 over the floor surface, which in turn causes the wheels 24, 26 of the rolling assembly 20, the wheel assemblies 38 and the rolling element 58 to rotate and move the vacuum cleaner 10 over the floor surface. To steer the vacuum cleaner 10 to the left, for example, as it is moving across the floor surface, the user pulls the hose of the hose and wand assembly to the left so that the inlet section 48 of the inlet duct 28 and the yoke 56 connected thereto pivot to the left about the yoke pivot axis. This pivoting movement of the inlet section 48 causes the hose 52 to flex and exert a force on the outlet section 50 of the inlet duct 28. This force causes the outlet section 50 to pivot about the duct pivot axis. Due to the flexibility of the hose 52, the amount by which the inlet section 48 pivots about yoke pivot axis is greater than the amount by which the outlet section 50 pivots about the duct pivot axis. For example, when the inlet section 48 is pivoted by an angle of 65° the outlet section 50 is pivoted by an angle of around 20°. As the outlet section 50 pivots about the duct pivot axis, the arm 46 moves the track control arm 42 relative to the chassis 32. The movement of the track control arm 42 causes each steering arm 40 to pivot so that the wheel assemblies 38 turn to the left, thereby changing the direction in which the vacuum cleaner 10 moves over the floor surface.

The inlet duct 28 also comprises a support 60 upon which the separating apparatus 12 is removably mounted. The support 60 is connected to the outlet section 50 of the inlet duct 28 for movement therewith as the outlet section 50 pivots about the duct pivot axis. The support 60 extends forwardly, and generally horizontally, from the outlet section 50 so as to extend over the hose 52 of the inlet duct 28. The support 60 is formed from a relatively rigid material, preferably a plastics material, so that the support 60 does not crush the hose 52 when the separating apparatus 12 is mounted on the support 60. The support 60 comprises an inclined front section 62 bearing a spigot 64 which extends upwardly therefrom for location within a recess 66 formed in the base 18 of the outer bin 14. When the separating apparatus 12 is mounted on the support 60, the longitudinal axis of the outer bin 14 is inclined to the duct pivot axis, in this example by an angle in the range from 30 to 40°. Consequently, pivoting movement of the inlet duct 28 about the duct pivot axis as the vacuum cleaner 10 is maneuvered over a floor surface causes the separating apparatus 12 to pivot, or swing, about the duct pivot axis, relative to the chassis 32, the rolling assembly 20 and the outlet duct 30.

The outlet section 50 of the inlet duct 48 comprises an air outlet 68 from which a dirt-bearing air flow enters the separating apparatus 12. The separating apparatus 12 is illustrated in FIGS. 4 to 7. The specific overall shape of the separating apparatus 12 can be varied according to the size and type of vacuum cleaner in which the separating apparatus 12 is to be used. For example, the overall length of the separating apparatus 12 can be increased or decreased with respect to the diameter of the apparatus, or the shape of the base 18 can be altered.

As mentioned above, the separating apparatus 12 comprises an outer bin 14 which has an outer wall 16 which is substantially cylindrical in shape. The lower end of the outer bin 14 is closed by a curved base 18 which is pivotably attached to the outer wall 16 by means of a pivot 70 and held in a closed position by a catch 72 which engages a groove located on the outer wall 16. In the closed position, the base 18 is sealed against the lower end of the outer wall 16. The catch 72 is resiliently deformable so that, in the event that downward pressure is applied to the uppermost portion of the catch 72, the catch 72 will move away from the groove and become disengaged therefrom. In this event, the base 18 will drop away from the outer wall 16.

Figure 7A:
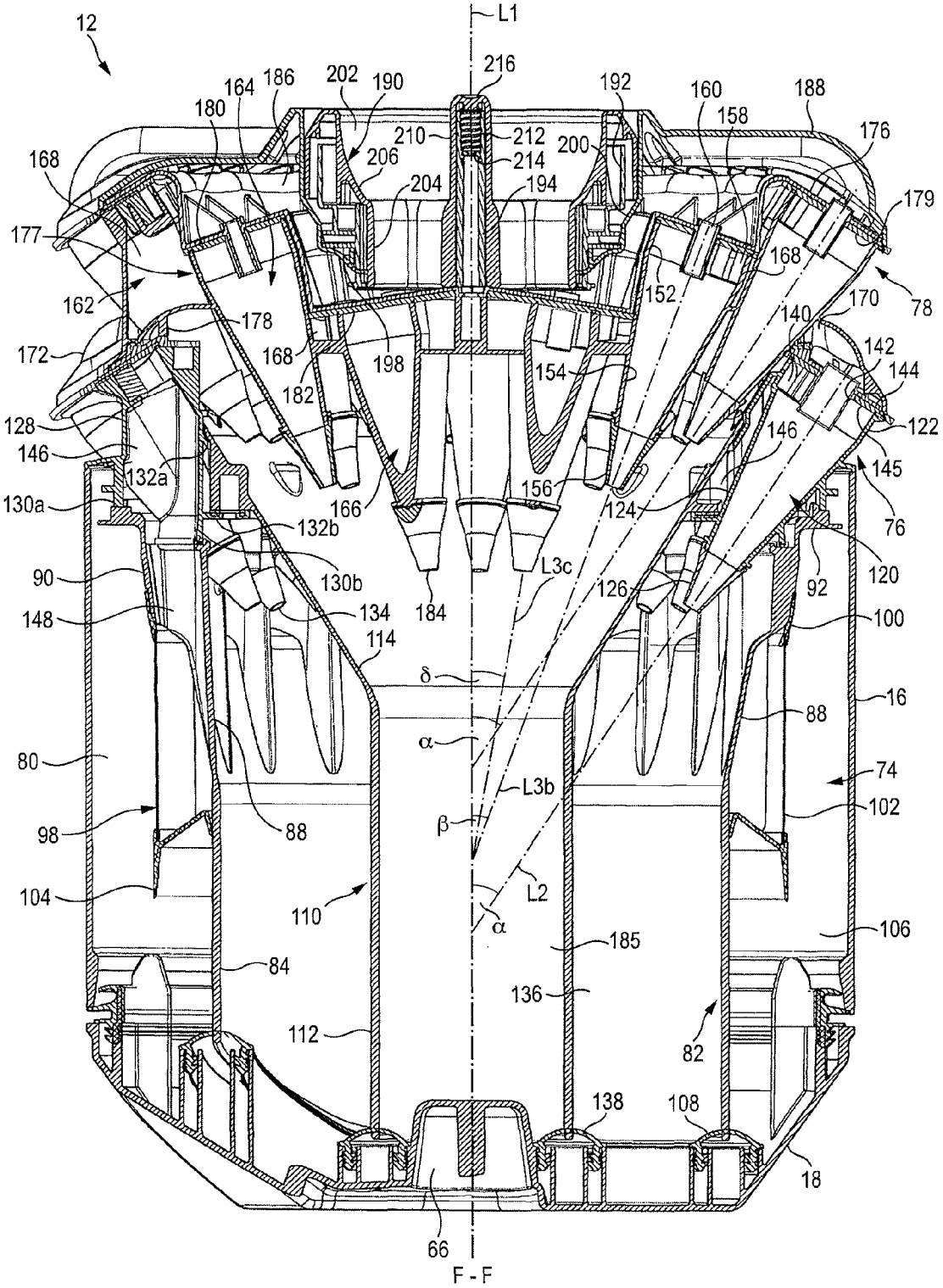
FIG. 7(*a*) is a side sectional view of the separating apparatus, taken along line F-F in FIG. 4, and FIG. 7(*b*) is the same sectional view as FIG. 7(*a*) but with background material omitted.
Figure 7B:
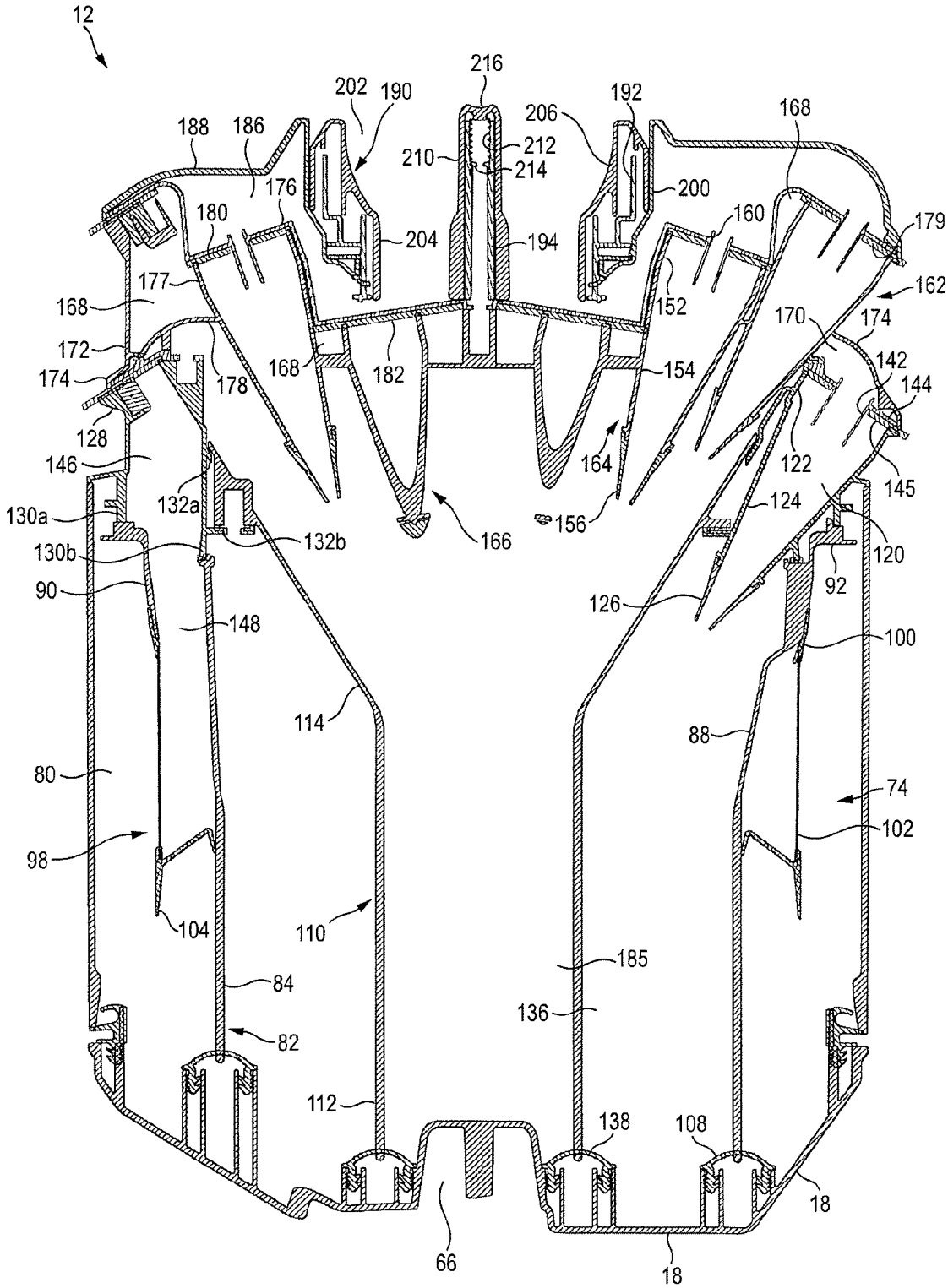

With particular reference to FIG. 7(*a*), the separating apparatus 12 comprises three stages of cyclonic separation. The separating apparatus 12 comprises a first cyclonic separating unit 74, a second cyclonic separating unit 76 which is located downstream from the first cyclonic separating unit 74, and a third cyclonic separating unit 78 which is located downstream from the second cyclonic separating unit 76.

The first cyclonic separating unit 74 comprises a single first cyclone 80. The first cyclone 80 is generally annular in shape, and has a longitudinal axis L1. The first cyclone 80 is located between the outer wall 16 of the outer bin 14, and a first inner wall 82 of the separating apparatus 12. The first inner wall 82 extends about the longitudinal axis L1. The first inner wall 82 has a generally cylindrical lower section 84 and an annular upper section. The upper section comprises an inner wall section 88, and a generally frusto-conical outer wall section 90 extending about an upper portion of the inner wall section 88. As illustrated in FIG. 6(*a*) and FIG. 7(*a*), the inner wall section 88 has a generally scalloped profile.

A flange 92 extends radially outwardly from the upper end of the outer wall section 90. An annular seal (not shown) may be located on the flange 92 for engaging the inner surface of the outer wall 16, and thereby form a seal between the outer wall 16 and the first inner wall 82.

A dirty air inlet 96 is provided towards the upper end of the outer wall 16 for receiving an air flow from the air outlet 68 of the inlet duct 28. The dirty air inlet 96 is located over the air outlet 68 of the inlet duct 28 when the separating apparatus 12 is mounted on the support 60. The dirty air inlet 96 is arranged tangentially to the outer bin 14 so as to ensure that incoming dirty air is forced to follow a helical path as it enters the separating apparatus 12.

A fluid outlet from the first cyclonic separating unit 74 is provided in the form of a perforated shroud 98. The shroud 98 has an annular upper wall 100 which is connected to the outer surface of the outer wall section 90 of the upper section of the first inner wall 82, a generally cylindrical side wall 102 which depends from the upper wall 100 so that it is spaced radially from the cylindrical lower section 84 of the first inner wall 82, and an annular lower wall 104 which extends radially inwardly from the lower end of the side wall 102 to engage the outer surface of the lower section 84 of the first inner wall 82. In this embodiment, the side wall 102 comprises a mesh which extends between the upper wall 100 and the lower wall 104. With reference to FIG. 6(*a*), the mesh is radially supported by a plurality of axially-extending ribs 105 angularly spaced about the outer surface of the first inner wall 82. The lower wall 104 may have a substantially cylindrical outer wall, as illustrated in FIG. 7(*a*), or it may have an outer wall which tapers outwardly away from the lower end of the side wall 102.

The separating apparatus 12 includes a first dust collector 106 for receiving dust separated from an air flow by the first cyclone 80. The first dust collector 106 is generally annular in shape, and extends from the lower end of the lower wall 104 of the shroud 98 to the base 18, and from the outer wall 16 to the lower section 84 of the first inner wall 82. When the base 18 is in a closed position, the lower end of the lower section 84 is sealed against a first annular sealing member 108 which is carried by the base 18.

The separating apparatus 12 includes a second inner wall 110. The first inner wall 82 extends about the second inner wall 110, and is substantially co-axially aligned with the second inner wall 110. The second inner wall 110 is generally funnel shaped, and has a cylindrical lower section 112 which is radially spaced from the cylindrical lower section 84 of the inner wall 82 to define an annular chamber therebetween. The second inner wall 110 also has a frusto-conical upper section 114 which flares radially outwardly from the upper end of the lower section 112 of the second inner wall 110, and which is radially spaced from the inner wall section 88 of the first inner wall 82.

As mentioned above, the second cyclonic separating unit 76 is located downstream from the first cyclonic separating unit 74. The second cyclonic separating unit 76 comprises at least one second cyclone for receiving the air flow exhausted from the first cyclonic separating unit 74. In this embodiment, the second cyclonic separating unit 76 comprises a plurality of second cyclones 120 arranged in parallel. The second cyclones 120 are arranged in a generally frusto-conical arrangement which extends about, and is centered on, the longitudinal axis L1. Within this arrangement, the second cyclones 120 are equidistantly spaced from the longitudinal axis L1, and are generally equi-angularly spaced about the longitudinal axis L1. Each second cyclone 120 is identical to the other second cyclones 120. In this embodiment, the second cyclonic separating unit 76 comprises eighteen second cyclones 120. Within this arrangement, the second cyclones 120 may have a gap 191 between two second cyclones 120 in which a button 121 or some other device, catch or mechanism is located.

Each second cyclone 120 has a cylindrical upper section 122 and a tapering body section which is preferably frusto-conical in shape. The body section is divided into an upper portion 124 and a lower portion 126. The upper portion 124 of the body of each second cyclone 120 is integral with the upper section 122, and forms part of a first molded cone pack 128 of the separating apparatus 12. The lower portion 126 of the body is formed from material which has greater flexibility than the upper portion 124. In this embodiment, the body of each second cyclone 120 has a lower portion 126 which is preferably overmolded with its upper portion 124. Alternatively, the lower portion 126 may be glued, fixed or clamped to the upper portion 124 by any suitable method or by using any suitable fixing means. Whichever technique is used to connect the lower portion 126 to the upper portion 124, the connection is preferably such that there is no significant step or other discontinuity on the inner surface of the body section at the joint between the upper portion 124 and the lower portion 126. The lower portion 126 is preferably formed from a rubber material, which may have a Shore A value of from around 20, to 50 and preferably 48, whereas the upper portion 124 is preferably formed from polypropylene, or ABS which may have a shore D value of around 60.

The first cone pack 128 has a pair of outer support walls 130*a*, 130*b*. The first outer support wall 130*a* is mounted on the flange 92 of the first inner wall 82, and the second outer support wall 130*b* is mounted on the upper end of the inner wall section 88 of the first inner wall 82. The first cone pack 128 also has a pair of inner support walls 132*a*, 132*b* which support the upper section 114 of the second inner wall 110.

The first cone pack 128 is angularly aligned relative to the inner walls 82, 110 so that the upper portion 124 of the body of each second cyclone 120 extends into the chamber located between the inner walls 82, 110. The lower portion 126 of each second cyclone 120 terminates in a cone opening 134 from which dirt and dust is discharged from the second cyclone 120. The cone opening 134 is located between the inner walls 82, 110, and so the annular chamber located between the inner walls 82, 110 provides a second dust collector 136 for receiving dust separated from the air flow by the second cyclones 120. The second dust collector 136 is thus generally annular in shape, and extends from the base 18 to an upper extremity located 10 mm beneath the lowest extremities of the second cyclones 120, which in this embodiment are the lowest extremities of the tips of the second cyclones 120. When the base 18 is in a closed position, the lower end of the lower section 112 of the second inner wall 110 is sealed against a second annular sealing member 138 which is carried by the base 18. The first dust collector 106 extends about the second dust collector 136.

The second cyclones 120 are arranged at a first orientation to the longitudinal axis L1. Each second cyclone 120 has a longitudinal axis L2, and the second cyclones 120 are arranged so that the longitudinal axes L2 of the second cyclones 120 approach one another. In this embodiment, the longitudinal axes L2 of the second cyclones 120 intersect the longitudinal axis L1 of the first cyclone 80 at a first angle $\alpha$, which in this embodiment is around 33°. The orientation of the second cyclones 120 to the longitudinal axis L1 is such that the first cyclone 80 extends about a lower part of each of the second cyclones 120, whereas an upper part of each of the second cyclones 120 is located above the first cyclone 80. As can be seen from FIG. 4, the external surface of the first cone pack 128 includes part of the upper section 122 and part of the upper portion 124 of the body section of each second cyclone 120. The external surface of the first cone pack 128 also forms part of the external surface of the separating apparatus 12, which in turn forms part of the external surface of the vacuum cleaner 10.

Figure 4:
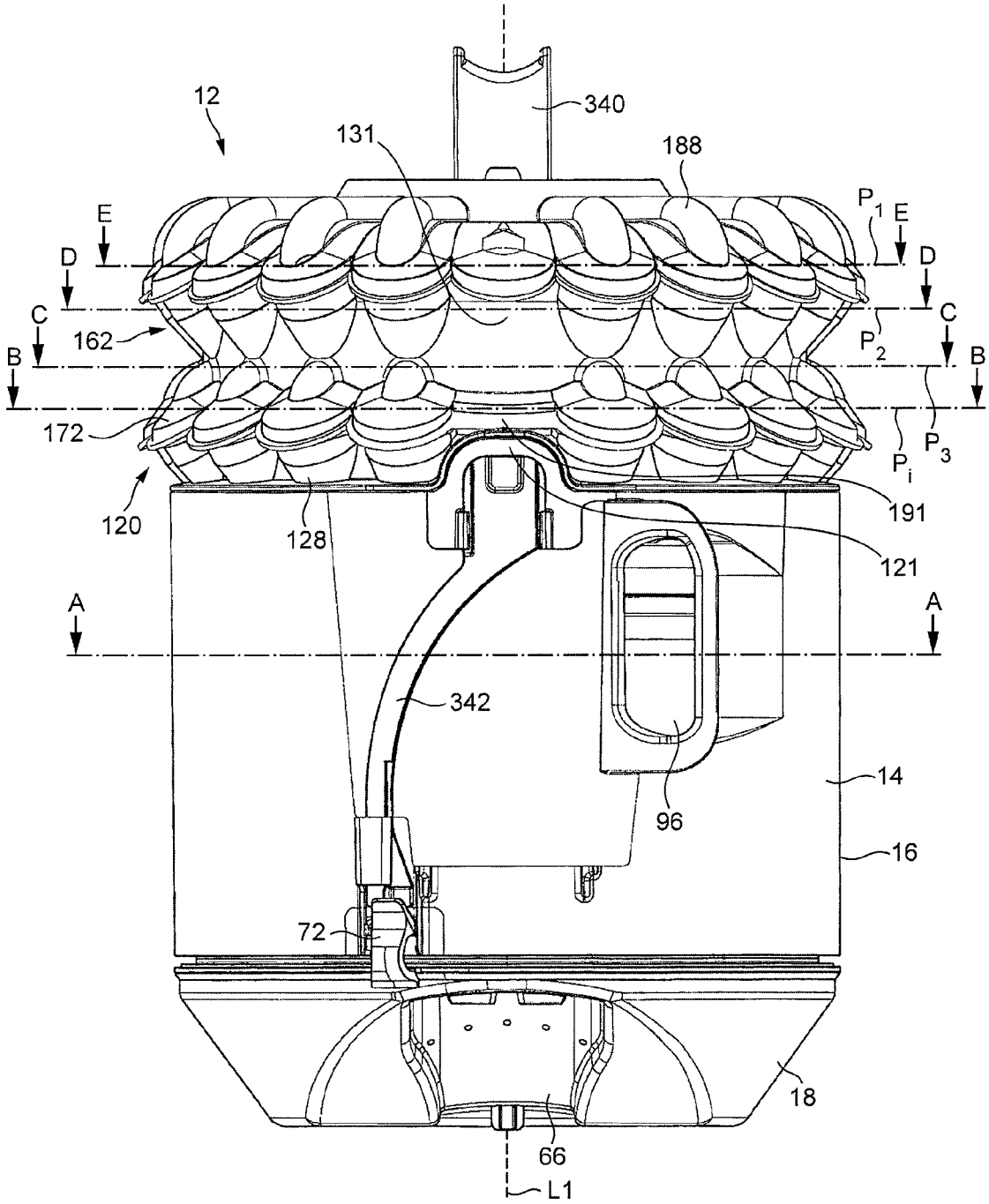
FIG. 4 is a side view of the separating apparatus.

Each second cyclone 120 has a fluid inlet 140 and a fluid outlet 142. For each second cyclone 120, the fluid inlet 140 is located in the cylindrical upper section 122 of the second cyclone 120, and is arranged so that air enters the second cyclone 120 tangentially. The fluid inlets 140 are generally arranged in an annular arrangement about the longitudinal axis L1. The annular arrangement is substantially orthogonal to the longitudinal axis L1, although of course within this annular arrangement the fluid inlets 140 are inclined to the longitudinal axis L1 in view of the inclination of the second cyclones 120 relative to the longitudinal axis L1. FIG. 6(*b*) is a top sectional view of the separating apparatus 12 taken along a plane $P_i$ passing through the fluid inlets 140 of the second cyclones 120. Plane $P_i$ is indicated in FIG. 4, and is substantially orthogonal to the longitudinal axis L1. The fluid outlet 142 is in the form of a vortex finder which is provided at the upper end of each second cyclone 120. The vortex finders are located in a first annular vortex finder plate 144 which covers the open upper ends of the second cyclones 120. Annular sealing member 145 forms an air tight seal to prevent air from leaking between the first cone pack 128 and the first vortex finder plate 144.

Air is conveyed from the first cyclonic separating unit 74 to the fluid inlets 140 of the second cyclones 120 of the second cyclonic separating unit 76 by a first manifold 146. The first manifold 146 extends about the longitudinal axis L1, and comprises a series of inlet passages 148 which receive air from between the side wall 102 of the shroud 98 and the lower section 84 of the first inner wall 82. The passages 148 are defined between the inner wall section 88 and the outer wall section 90 of the upper section of the first inner wall 82, and are thus arranged about the upper extremity of the second dust collector 136. Each passage 148 extends between adjacent lower portions 126 of the second cyclones 120. The fluid inlets 140 of the second cyclones 120 communicate with the first manifold 146 to receive air from the inlet passages 148. The first manifold 146 is enclosed by the first cone pack 128, and the upper section 114 of the second inner wall 110. The second cyclones 120 may therefore be considered to extend through the first manifold 146.

As mentioned above, a third cyclonic separating unit 78 is located downstream from the second cyclonic separating unit 76. The third cyclonic separating unit 78 comprises a plurality of third cyclones arranged in parallel. In this embodiment, the third cyclonic separating unit 78 comprises thirty six third cyclones. Each third cyclone is identical to the other third cyclones. In this embodiment, each third cyclone is also substantially the same as each of the second cyclones 120. However, the third cyclones may have a different size to the second cyclones 120.

The third cyclones have substantially the same size and shape as the second cyclones 120. As with the second cyclones 120, each third cyclone has a cylindrical upper section 152 and a tapering body section which is preferably frusto-conical in shape. The body section is divided into an upper portion 154 and a lower portion 156. The upper portion 154 of each third cyclone 150 is integral with the upper section 152. The upper portions 154 and the lower portions 156 of the bodies of the third cyclones are each preferably formed form the same material as the upper portions 124 and the lower portions 126 of the second cyclones 120, respectively. The lower portions 156 are preferably joined to the upper portions 154 in a similar manner as the lower portions 126 of the second cyclones 120 are joined to the upper portions 124 of the second cyclones 120. Each third cyclone has a fluid inlet 158 and a fluid outlet 160. For each third cyclone, the fluid inlet 158 is located in the cylindrical upper section 152 of the third cyclone, and is arranged so that air enters the third cyclone tangentially. The fluid outlet 160 is in the form of a vortex finder which is provided at the upper end of each third cyclone.

To reduce the diameter of the separating apparatus 12, the third cyclones are arranged in a plurality of sets. In this embodiment, the third cyclonic separating unit 78 comprises a first set of third cyclones 162, a second set of third cyclones 164, and a third set of third cyclones 166. Each set contains a respective different number of third cyclones. The first set of third cyclones 162 contains eighteen third cyclones, the second set of third cyclones 164 contains twelve cyclones, and the third set of third cyclones 166 contains six third cyclones.

The first set of third cyclones 162 is located above the second cyclones 120. In this example, the arrangement of the third cyclones within the first set of third cyclones 162 is substantially the same as the arrangement of the second cyclones 120. The third cyclones are arranged in a generally frusto-conical arrangement which extends about, and is centered on, the longitudinal axis L1. Within this arrangement, the third cyclones are equidistantly spaced from the longitudinal axis L1, and are generally equi-angularly spaced about the longitudinal axis L1. The radial spacing of the third cyclones from the longitudinal axis L1 is substantially the same as the radial spacing of the second cyclones 120 from the longitudinal axis L1. Again there may be a gap 131 between two third cyclones 162 in which a button 151 or some other device, catch or mechanism is located.

The first set of third cyclones 162 is also arranged at the same orientation to the longitudinal axis L1 as the second cyclones 120. In other words, within this set the third cyclones are arranged at the first orientation to the longitudinal axis L1. Each cyclone of the first set of third cyclones 162 has a longitudinal axis L3*a*, and the cyclones are arranged so that their longitudinal axes L3*a* approach one another, and intersect the longitudinal axis L1 at the first angle $\alpha$.

Each cyclone of the first set of third cyclones 162 is located immediately above a respective one of the second cyclones 120. To minimize the increase in the height of the separating apparatus 12, the first set of third cyclones 162 is arranged so that an upper portion of the second cyclones 120 extends about, or overlaps, a lower portion of the first set of third cyclones 162.

The first set of third cyclones 162 extends about the second set of third cyclones 164. The cyclones of the second set of third cyclones 164 are also arranged in a generally frusto-conical arrangement which extends about, and is centered on, the longitudinal axis L1. Within this arrangement, the third cyclones are equidistantly spaced from the longitudinal axis L1, and are equi-angularly spaced about the longitudinal axis L1, but the radial spacing of the cyclones from the longitudinal axis L1 is smaller than that of the cyclones of the first set of third cyclones 162.

To allow the first and second sets of third cyclones to have a compact arrangement within the third cyclonic separating unit 78, the second set of third cyclones 164 is arranged at a different orientation to the longitudinal axis L1. Within this second set the cyclones are arranged at a second orientation to the longitudinal axis L1. Each cyclone of the second set of third cyclones 164 has a longitudinal axis L3*b*, and the cyclones are arranged so that their longitudinal axes L3*b* approach one another, and intersect the longitudinal axis L1 at a second angle $\beta$ which is smaller than the angle $\alpha$. In this embodiment, the angle $\beta$ is around 20°.

To reduce the height of the separating apparatus 12, the second set of third cyclones 164 is located partially beneath the first set of third cyclones 162 so that the a lower portion of the first set of third cyclones 162 extends about an upper portion of the second set of third cyclones 164. Consequently, the second cyclones 120 extend about both the first set of third cyclones 162 and the second set of third cyclones 164, overlapping each set by a respective different amount.

The arrangement of the first and second sets of third cyclones 162, 164 is such that the fluid inlets 158 of the first set of third cyclones 162 are arranged in a first group, and the fluid inlets 158 of the second set of third cyclones 164 are arranged in a second group which is spaced along the longitudinal axis L1 from the first group. Within each group, the fluid inlets 158 are generally arranged in an annular arrangement about the longitudinal axis L1, with the annular arrangement being substantially orthogonal to the longitudinal axis L1. Again, within each annular arrangement the fluid inlets 158 are inclined to the longitudinal axis L1 in view of the inclination of the third cyclones to the longitudinal axis L1. FIG. 6(*e*) is a top sectional view of the separating apparatus 12 taken along plane $P_1$ passing through the fluid inlets of the first set of third cyclones 162, and FIG. 6(*d*) is a top sectional view of the separating apparatus 12 taken along plane $P_2$ passing through the fluid inlets of the second set of third cyclones 164. As illustrated in FIG. 4, each of these planes $P_1$, $P_2$ is substantially orthogonal to the longitudinal axis L1. The planes $P_1$, $P_2$ are spaced along the longitudinal axis L1, with plane $P_1$ located above plane $P_2$.

The second set of third cyclones 164 extends about the third set of third cyclones 166. The cyclones of the third set of third cyclones 166 are also arranged in a generally annular arrangement which extends about, and is centered on, the longitudinal axis L1. Within this arrangement, the third cyclones are equidistantly spaced from the longitudinal axis L1, and are equi-angularly spaced about the longitudinal axis L1, but the radial spacing of the third cyclones from the longitudinal axis L1 is smaller than that of the cyclones of the first and second sets of third cyclones 162, 164.

To maximize the number of cyclones within the third set of third cyclones 166, the third set of third cyclones 166 is arranged at a different orientation to the second set of third cyclones 164. Within this third set the cyclones are arranged at a third orientation to the longitudinal axis L1. Each cyclone of the second set of third cyclones 164 has a longitudinal axis L3*c*, and the cyclones are arranged so that their longitudinal axes L3*c* approach one another, and intersect the longitudinal axis L1 at a third angle γ which is smaller than the angle β. In this embodiment, the angle γ is around 10°.

The third set of third cyclones 166 is also located partially beneath the second set of third cyclones 164 so that the lower portion of the second set of third cyclones 164 extends about an upper portion of the third set of third cyclones 166. As shown in FIG. 4, the second cyclones 120 extend about each of the sets of third cyclones, overlapping each set by a respective different amount.

The arrangement of the third set of third cyclones 166 is also such that the fluid inlets 158 of the third set of third cyclones 166 are arranged in a third group which is spaced along the longitudinal axis L1 from the first and second groups. Within this third group, the fluid inlets 158 are generally arranged in an annular arrangement about the longitudinal axis L1, with the annular arrangement being substantially orthogonal to the longitudinal axis L1. Again, within each annular arrangement the fluid inlets 158 are inclined to the longitudinal axis L1 in view of the inclination of the third cyclones to the longitudinal axis L1. FIG. 6(*c*) is a top sectional view of the separating apparatus 12 taken along plane $P_3$ passing through the fluid inlets of the third set of third cyclones 166. As illustrated in FIG. 4, plane $P_3$ is substantially orthogonal to the longitudinal axis L1. The planes $P_1$, $P_2$ are located above plane $P_3$.

Air is conveyed from the second cyclonic separating unit 76 to the third cyclonic separating unit 78 by a second manifold 168. The second manifold 168 comprises a series of inlet passages 170 which each receive air from the fluid outlet 140 of a respective second cyclone 120. With reference to FIGS. 7(*a*) and 7(*b*), the upper portion 154 of the body of each cyclone of the first set of third cyclones 162 is integral with the upper section 152 of each cyclone, and forms part of a second molded cone pack 172 of the separating apparatus 12. The second cone pack 172 has a lower annular support wall 174 which is mounted on the first cone pack 128. The support wall 174 extends over the first vortex finder plate 144 to define the inlet passages 170 therewith. As can be seen from FIG. 4, the external surface of the second cone pack 172 includes part of the upper section 152 and part of the upper portion 154 of the body section of each cyclone of the first set of third cyclones 162. The external surface of the second cone pack 172 also forms part of the external surface of the separating apparatus 12, which in turn forms part of the external surface of the vacuum cleaner 10. As mentioned above, the fluid outlet 160 of each cyclone of the first set of third cyclones 162 is in the form of a vortex finder which is provided at the upper end of each cyclone. These vortex finders are located in a second vortex finder plate 176 which covers the open upper ends of the cyclones of the first set of third cyclones 162. Annular sealing member 179 forms an air tight seal to prevent air from leaking between the second cone pack 172 and the second vortex finder plate 176.

The second manifold 168 is defined in part by the second cone pack 172, and also in part by a third molded cone pack 177. The second cone pack 172 extends about the third cone pack 177. The second cone pack 172 may be a separate component to the third cone pack 177, or it may be integral with the third cone pack 177. The third cone pack 177 defines the upper section 152 and the upper portion 154 of the body of each cyclone of the second and third sets of third cyclones 164, 166. The third cyclones may therefore be considered to extend through the second manifold 168. The third cone pack 177 has a support 178 which extends about the outer surface of the third cone pack 177, and which is mounted on the first cone pack 128. The vortex finders which provide the fluid outlets 160 of the cyclones of each of the second and third sets of third cyclones 164, 166 are also located in the second vortex finder plate 176, which also covers the open upper ends of the cyclones of the second and third sets of third cyclones 164, 166. Sealing members 180, 182 form air tight seals to prevent air from leaking between the third cone pack 177 and the second vortex finder plate 176.

The lower portion 156 of the body of each third cyclone terminates in a cone opening 184 from which dirt and dust is discharged from the third cyclone. The inner surface of the second inner wall 110 defines a third dust collector 185 for receiving dust separated from the air flow by the third cyclones. The third dust collector 185 is generally cylindrical in shape, and extends from the base 18 to an upper extremity located 10 mm beneath the lowest extremities of the third cyclones, which in this embodiment are the lowest extremities of the tips of the cyclones of the third set of third cyclones 166. Consequently, depending on the position of the third set of third cyclones 166 along the longitudinal axis L1, the third dust collector 185 may have a generally frusto-conical upper section. Each of the first dust collector 106 and the second dust collector 136 extends about the third dust collector 185.

The volume of the second dust collector 136 is greater than the volume of each of the first dust collector 106 and the third dust collector 185. In this embodiment, the volume of the second dust collector 136 is greater than the sum of the volumes of the first and second dust collectors 106, 185.

The air exhausted from the cyclones of the third cyclonic separating unit 78 enters a fluid outlet chamber 186. Upper portions of the first and second sets of third cyclones 162, 164 extend about the fluid outlet chamber 186, whereas the third set of third cyclones 166 is located beneath the fluid outlet chamber 186. The fluid outlet chamber 186 is defined by the second cone pack 172, the third vortex finder plate 180 and a cover 188 which defines the upper wall of the separating apparatus 12. The cover 188 is mounted on the second cone pack 172.

Figure 5:
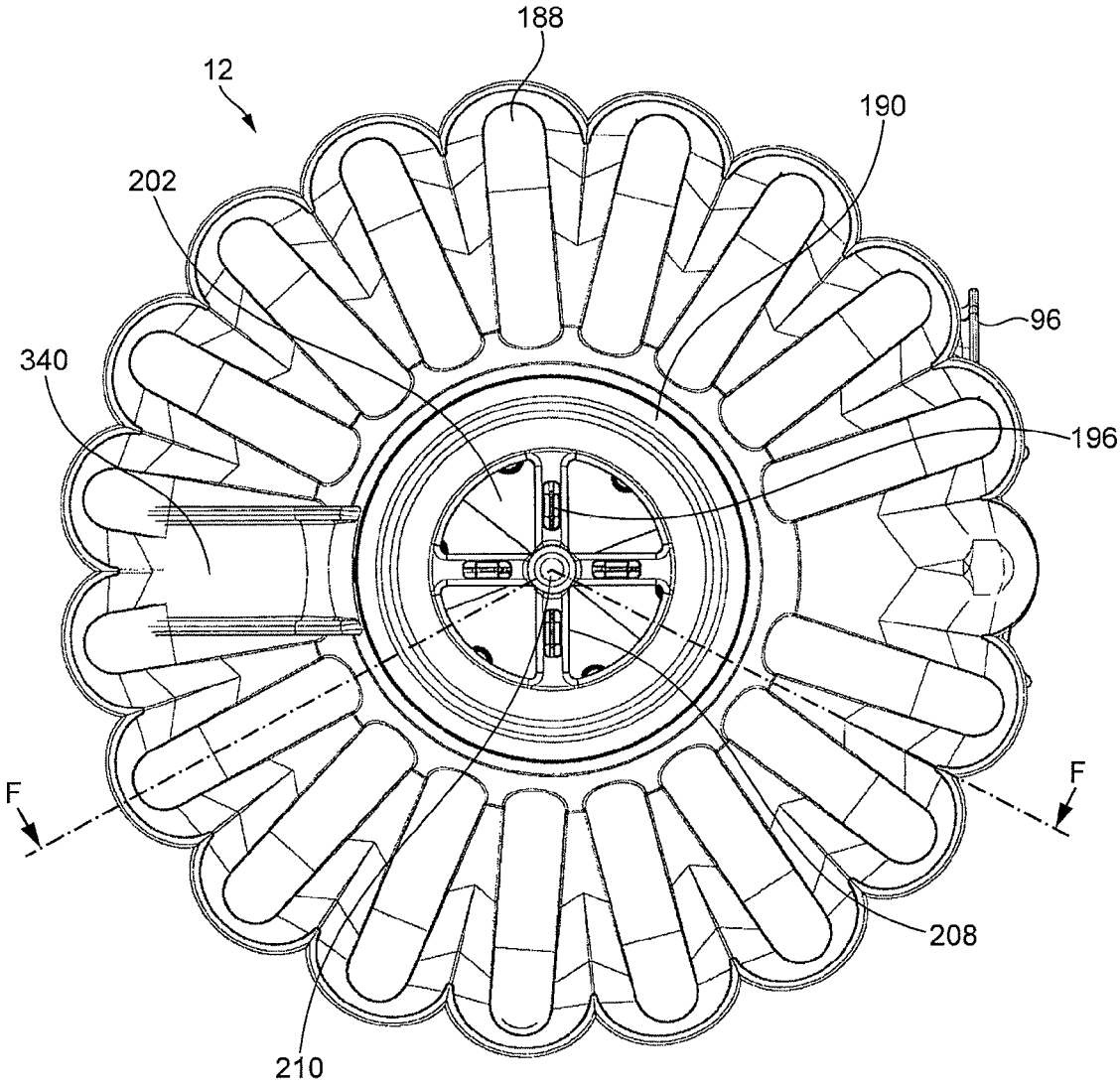
FIG. 5 is a top view of the separating apparatus.
Figure 6A:
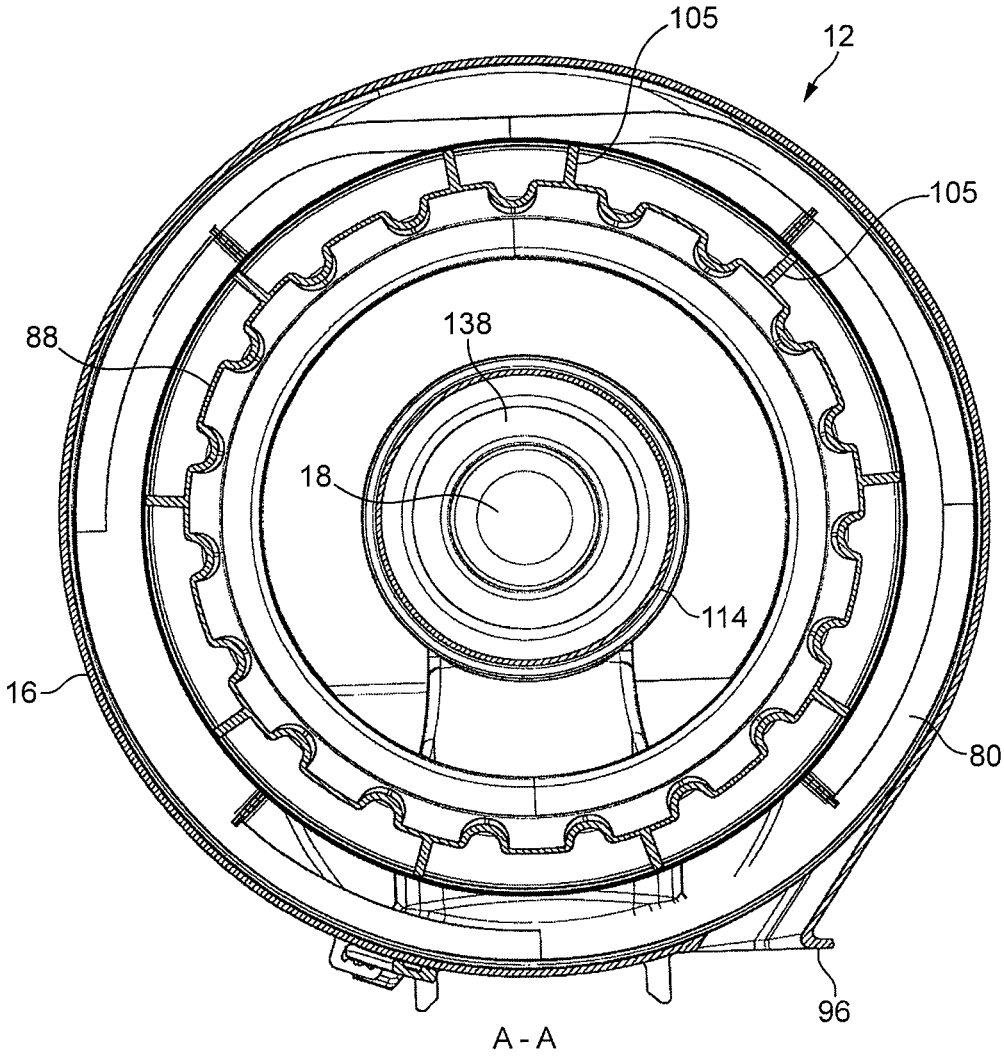
FIG. 6(*a*) is a top sectional view of the separating apparatus taken along line A-A in FIG. 5, FIG. 6(*b*) is a top sectional view taken along line B-B in FIG. 5, FIG. 6(*c*) is a top sectional view taken along line C-C in FIG. 5, FIG. 6(*d*) is a top sectional view taken along line D-D in FIG. 5, and FIG. 6(*e*) is a top sectional view taken along line E-E in FIG. 5.
Figure 6B:
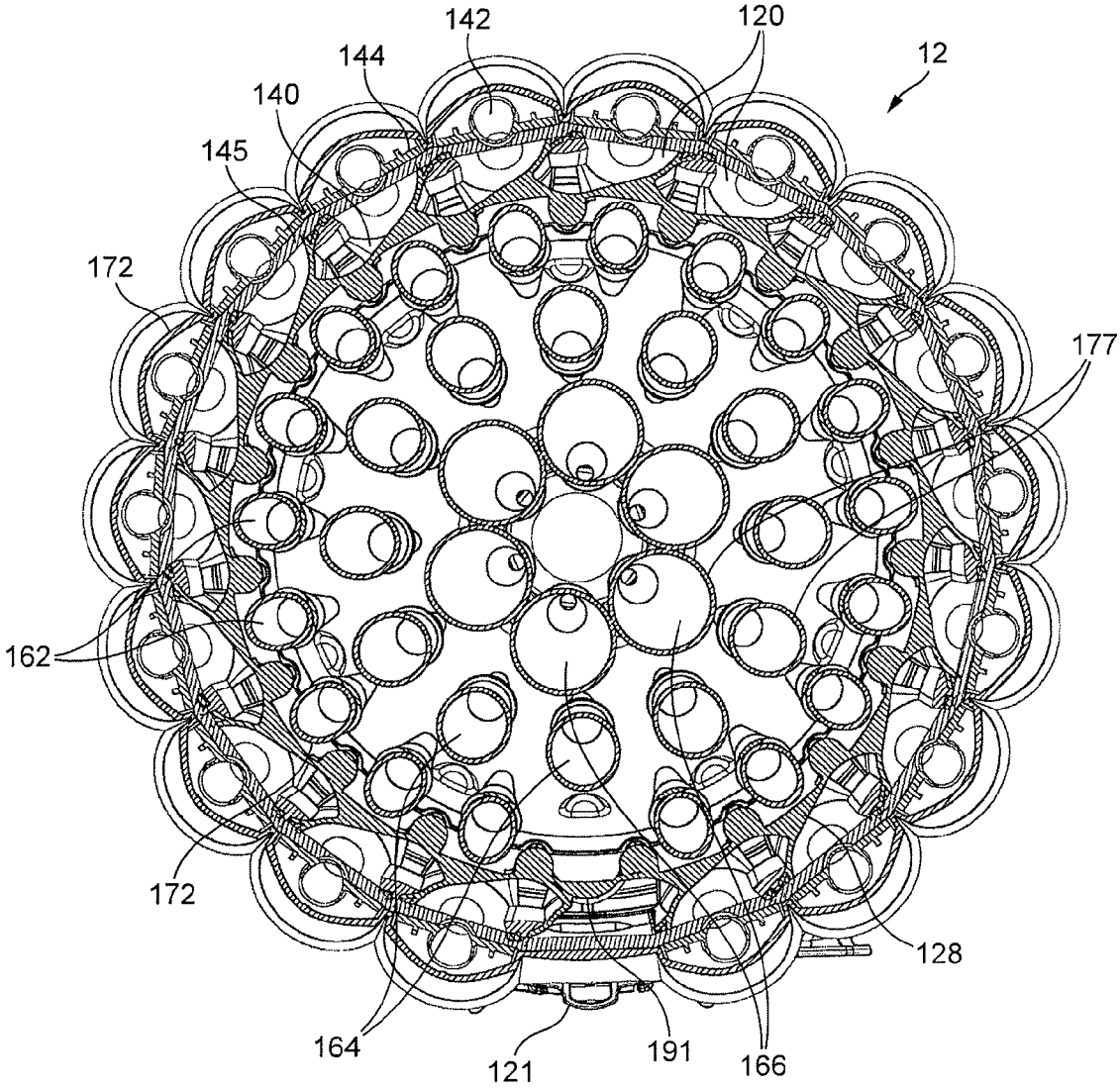
Figure 6C:
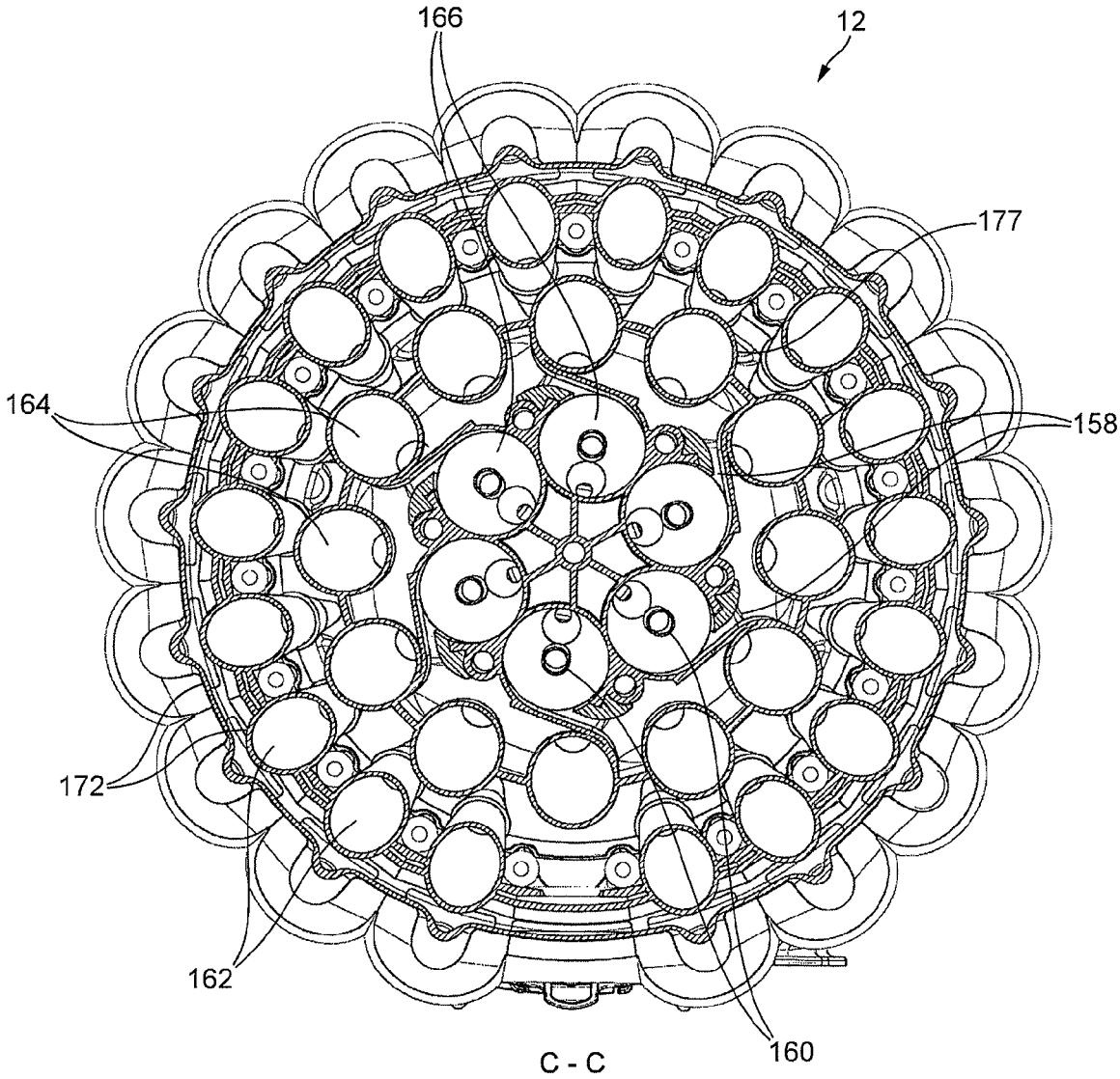
Figure 6D:
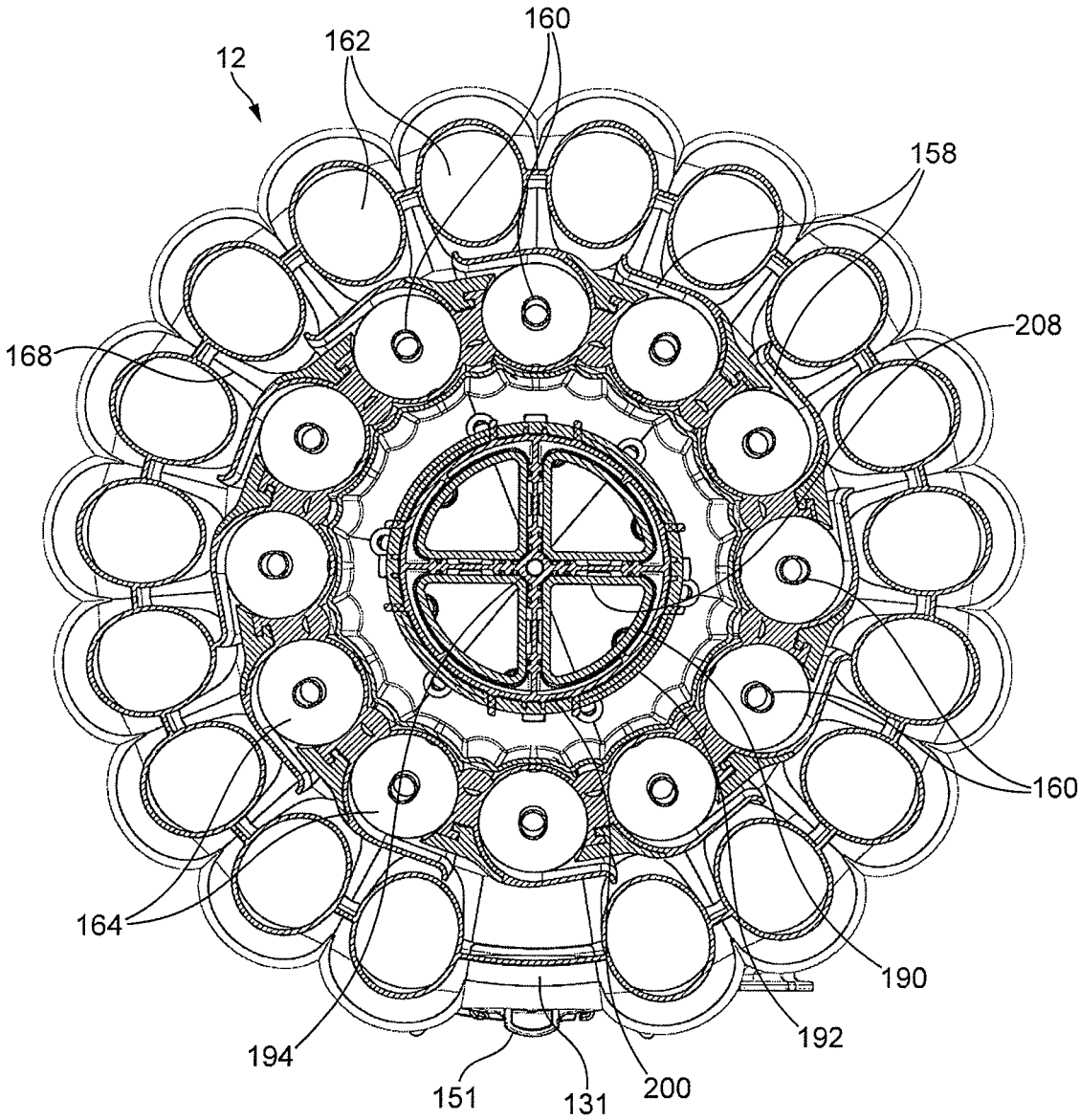
Figure 6E:
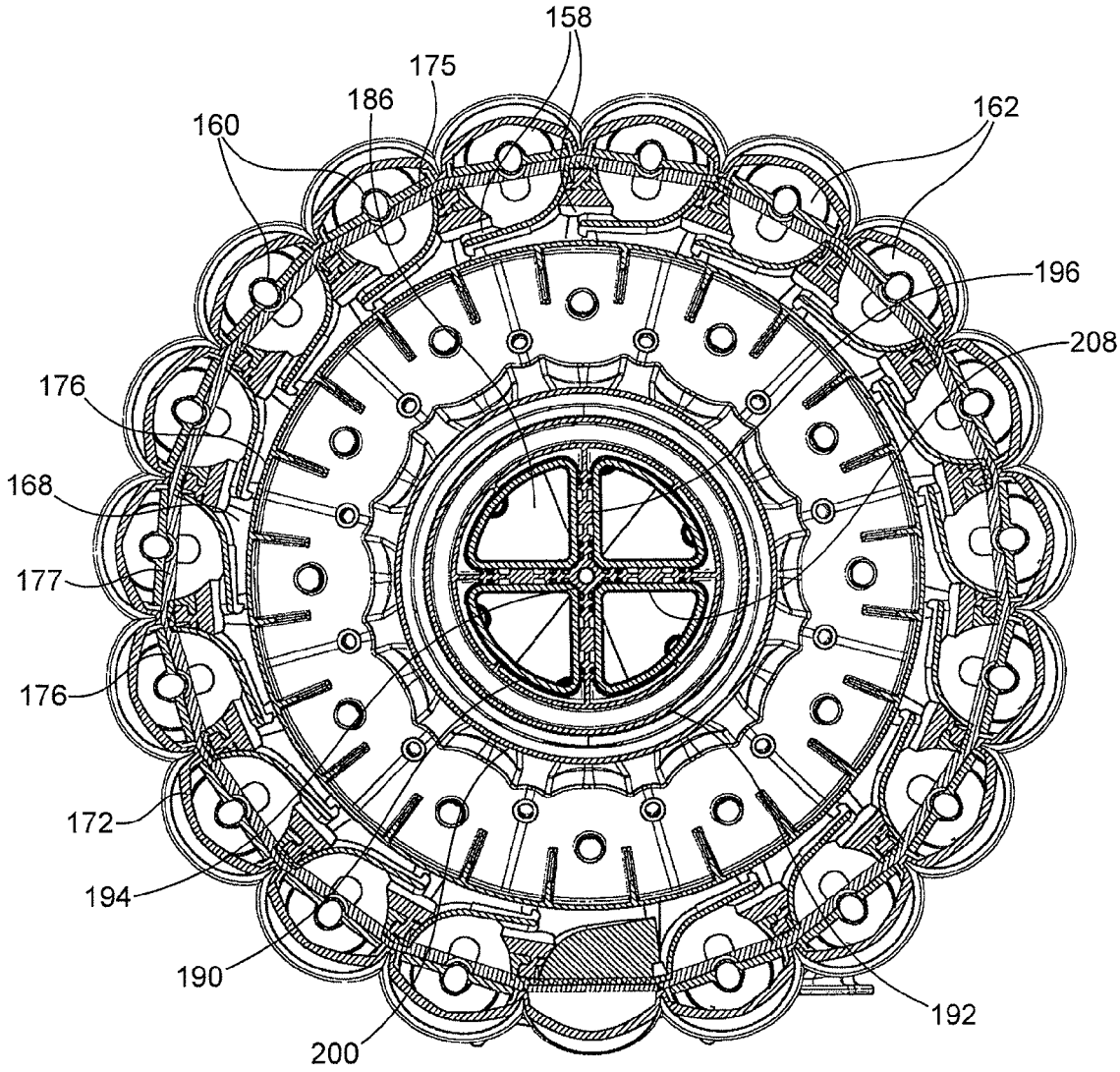

The cover 188 comprises a coupling member 190 for coupling the separating apparatus 12 to the outlet duct 30 of the vacuum cleaner. The coupling member 190 is supported by a coupling support member 192. The support member 192 is retained by the cover 188. The support member 192 is preferably a single-piece item, preferably molded from plastics material, but alternatively the support member 192 may formed from a plurality of components connected together. The support member 192 is generally tubular in shape, and comprises a central bore for receiving air from the outlet chamber 186. With reference also to FIGS. 5 and 6(*e*), the support member 192 comprises a central hub 194 located at one end thereof, and a plurality of spokes 196, in this example four spokes, which extend radially outwardly from the hub 194 to an outer wall of the support member 192 so as to define a plurality of apertures in the shape of quadrants between adjacent spokes 196. The hub 194 extends along the longitudinal axis L1. Returning to FIG. 7(*a*), an annular flange 198 extends radially outwardly from the outer surface of the support member 192, and is supported by an inner wall 200 of the cover 188.

The coupling member 190 comprises an air outlet 202 through which the air flow is exhausted from the separating apparatus 12. The coupling member 190 is substantially coaxial with the support member 192. With particular reference to FIGS. 7(*a*) and 7(*b*), the coupling member 190 is generally cup-shaped, and comprises a base 204 and an inner wall 206 extending upwardly from the edge of the base 204. Similar to the support member 192, the base 204 comprises a plurality of spokes 208 extending radially outwardly from a central hub 210. The hub 210 of the coupling member 190 also extends along the longitudinal axis L1, and surrounds the hub 194 of the support member 192. The coupling member 190 comprises the same number of spokes 208 as the support member 192. In this example, each spoke 208 of the coupling member 190 meshes with a respective spoke 196 of the support member 192; the spokes 196 of the support member 192 are visible in FIG. 5 through windows formed in the spokes 208 of the coupling member 190. The base 204 of the coupling member 190 thus also defines a plurality of apertures in the shape of quadrants between adjacent spokes 208, and which receive air from the fluid outlet chamber 186.

The coupling member 190 is moveable relative to the support member 192. A biasing force is applied to the coupling member 190 which urges the coupling member 190 in a direction extending along the longitudinal axis L1 to engage the outlet duct 30 of the vacuum cleaner 10. In this example the biasing force is applied by a resilient element 212, preferably a helical spring, located between the support member 192 and the coupling member 190. The resilient element 212 is located on the longitudinal axis L1. In this example the hubs 194, 210 are hollow, and the resilient element 212 is located within the hubs 194, 210. One end of the resilient element 212 engages a spring seat 214 located within the hub 194 of the support member 192, whereas the other end of the resilient element 212 engages the upper end 216 of the hub 210 of the coupling member 190.

The inner wall 206 of the coupling member 190 has a concave, or bowl-shaped, inner surface which engages the outlet duct 30 of the vacuum cleaner 10. With reference to FIGS. 2(*b*), 8(*a*) and 8(*b*), the outlet duct 30 comprises an annular sealing member 300 connected to an air inlet 302 of the outlet duct 30 for engaging the concave inner surface of the coupling member 190 continuously about the longitudinal axis L1. The air inlet 302 of the outlet duct 30 is generally dome-shaped. As described previously, movement of the outlet section 50 of the inlet duct 28 about the duct pivot axis during a cleaning operation causes the separating apparatus 12 to swing about the duct pivot axis relative to the outlet duct 30. The continuous engagement between the inner surface of the coupling member 190 and the sealing member 300 of the outlet duct 30, coupled with the bias of the coupling member 190 towards the outlet duct 30, enables a continuous air tight connection to be maintained between the separating apparatus 12 and the outlet duct 30 as the separating apparatus 12 moves relative to the outlet duct 30 during movement of the vacuum cleaner 10 across a floor surface.

The outlet duct 30 is generally in the form of a curved arm extending between the separating apparatus 12 and the rolling assembly 20. An elongated tube 304 provides a passage 306 for conveying air from the air inlet 302 to the rolling assembly 20.

The outlet duct 30 is moveable relative to the separating apparatus 12 to allow the separating apparatus 12 to be removed from the vacuum cleaner 10. The end of the tube 304 remote from the air inlet 302 of the outlet duct 30 is pivotably connected to the main body 22 of the rolling assembly 20 to enable the outlet duct 30 to be moved between a lowered position, shown in FIG. 2(*a*), in which the outlet duct 30 is in fluid communication with the separating apparatus 12, and a raised position, shown in FIG. 2(*b*), which allows the separating apparatus 12 to be removed from the vacuum cleaner 10.

Figure 8A:
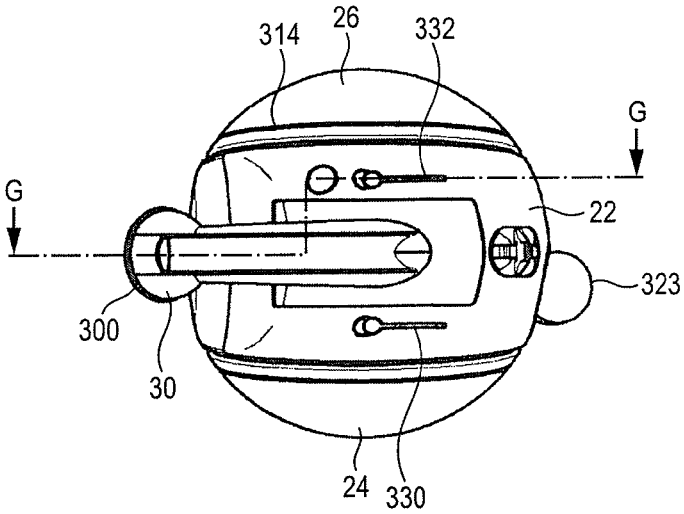
FIG. 8(*a*) is a top view of the rolling assembly, and FIG. 8(*b*) is a side sectional view taken along line G-G in FIG. 8(*a*).
Figure 8B:
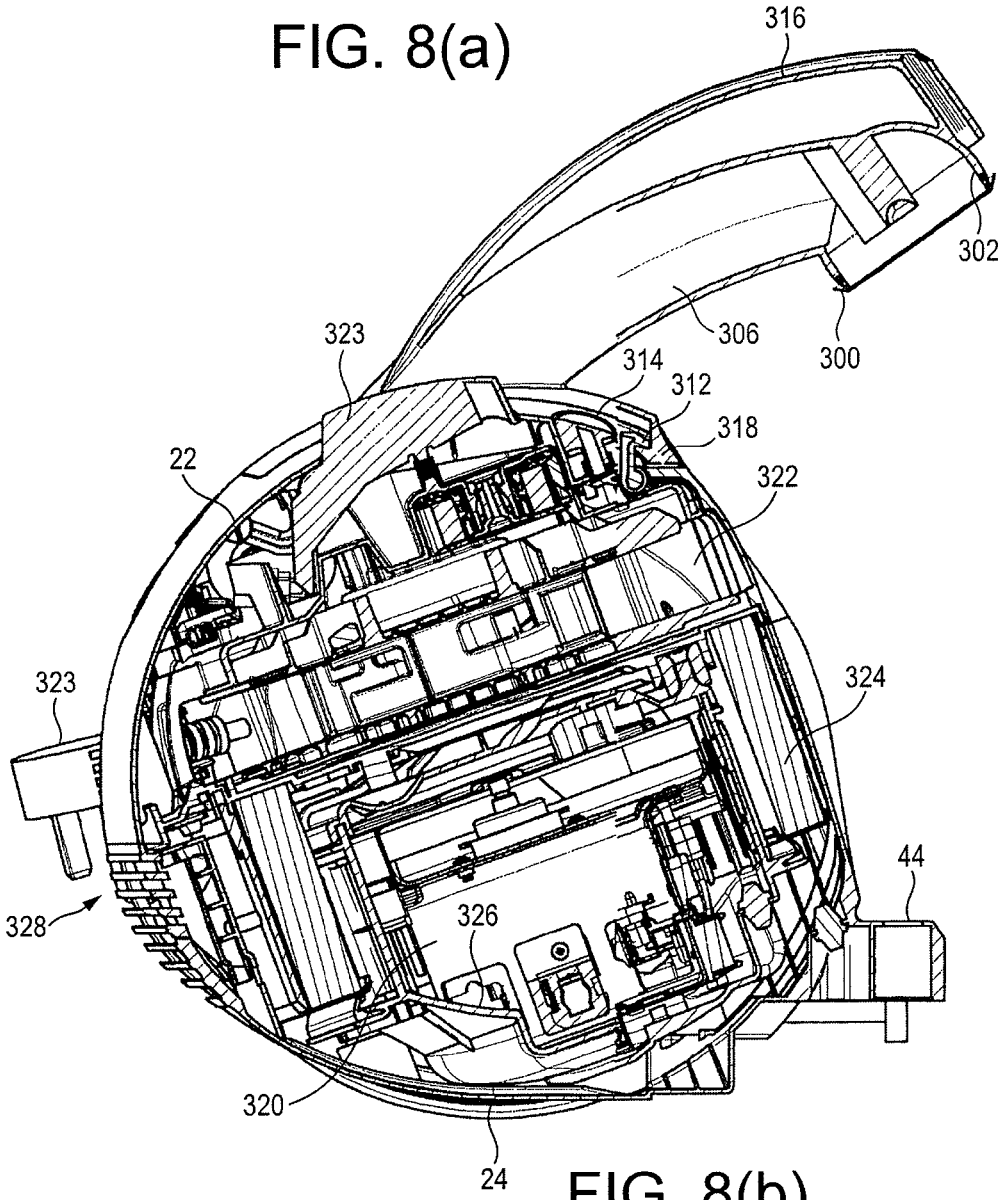

With reference to FIG. 8(*b*), the outlet duct 30 is biased towards the raised position by a torsion spring (not shown) located in the main body 22. The main body 22 also comprises a biased catch 312 for retaining the outlet duct 30 in the lowered position against the force of the torsion spring, and a catch release button 314. The outlet duct 30 comprises a handle 316 to allow the vacuum cleaner 10 to be carried by the user when the outlet duct 30 is retained in its lowered position. The catch 312 is arranged to co-operate with a finger 318 connected to outlet duct 30 to retain the outlet duct in its lowered position. Depression of the catch release button 314 causes the catch 312 to move away from the finger 318, against the biasing force applied to the catch 312, allowing the torsion spring to move the outlet duct 30 to its raised position.

The rolling assembly 20 will now be described with reference to FIGS. 8(*a*) and 8(*b*). As mentioned above, the rolling assembly 20 comprises a main body 22 and two curved wheels 24, 26 rotatably connected to the main body 22 for engaging a floor surface. In this embodiment the main body 22 and the wheels 24, 26 define a substantially spherical rolling assembly 20. The rotational axes of the wheels 24, 26 are inclined upwardly towards the main body 22 with respect to a floor surface upon which the vacuum cleaner 10 is located so that the rims of the wheels 24, 26 engage the floor surface. The angle of the inclination of the rotational axes of the wheels 24, 26 is preferably in the range from 4 to 15°, more preferably in the range from 5 to 10°, and in this embodiment is around 6°. Each of the wheels 24, 26 of the rolling assembly 20 is dome-shaped, and has an outer surface of substantially spherical curvature, so that each wheel 24, 26 is generally hemispherical in shape.

The rolling assembly 20 houses a motor-driven fan unit 320, a cable rewind assembly 322 for retracting and storing within the main body 22 a portion of an electrical cable (not shown) terminating in a plug 323 providing electrical power to, inter alia, the motor of the fan unit 220, and a filter 324. The fan unit 220 comprises a motor, and an impeller driven by the motor to drawn the dirt-bearing air flow into and through the vacuum cleaner 10. The fan unit 320 is housed in a motor bucket 326. The motor bucket 326 is connected to the main body 22 so that the fan unit 320 does not rotate as the vacuum cleaner 10 is maneuvered over a floor surface. The filter 324 is located downstream of the fan unit 320. The filter 324 is tubular and located around a part of the motor bucket 226.

The main body 22 further comprises an air exhaust port for exhausting cleaned air from the vacuum cleaner 10. The exhaust port is formed towards the rear of the main body 22. In the preferred embodiment the exhaust port comprises a number of outlet holes 328 located in a lower portion of the main body 22, and which are located so as to present minimum environmental turbulence outside of the vacuum cleaner 10.

A first user-operable switch 330 is provided on the main body and is arranged so that, when it is depressed, the fan unit 320 is energized. The fan unit 320 may also be de-energized by depressing this first switch 330. A second user-operable switch 332 is provided adjacent the first switch 330. The second switch 332 enables a user to activate the cable rewind assembly 22. Circuitry for driving the fan unit 320 and cable rewind assembly 322 is also housed within the rolling assembly 20.

In use, the fan unit 320 is activated by the user and a dirt-bearing air flow is drawn into the vacuum cleaner 10 through the suction opening in the cleaner head. The dirt-bearing air passes through the hose and wand assembly, and enters the inlet duct 28. The dirt-bearing air passes through the inlet duct 28 and enters the first cyclonic separating unit 74 of the separating apparatus 12 through the dirty air inlet 96. Due to the tangential arrangement of the dirty air inlet 96, the air flow follows a helical path relative to the outer wall 16 as it passes through the first cyclonic separating unit 74. Larger dirt and dust particles are deposited by cyclonic action in the first dust collector 106 and collected therein.

The partially-cleaned air flow exits the first cyclonic separating unit 74 via the perforations in the mesh of the side wall 102 of the shroud 98 and enters the first manifold 146. From the first manifold 146, the air flow enters the second cyclones 120 wherein further cyclonic separation removes some of the dirt and dust still entrained within the air flow. This dirt and dust is deposited in the second dust collector 136 while the cleaned air exits the second cyclones 120 via the fluid outlets 142 and enters the second manifold 168. From the second manifold 168, the air flow enters the third cyclones, wherein further cyclonic separation removes dirt and dust still entrained within the air flow. This dirt and dust is deposited in the third dust collector 185 while the cleaned air exits the third cyclones via the fluid outlets 160 and enters the fluid outlet chamber 186. The air flow enters the bore of the support member 192, and passes axially along the bore and between the spokes 196, 208 of the support member 192 and the coupling member 190 to be exhausted through the air outlet 202 of the coupling member 190 and into the dome-shaped air inlet 302 of the outlet duct 30.

The air flow passes along the passage 306 within the outlet duct 30, and enters the main body 22 of the rolling assembly 20. Within the rolling assembly 20, the air flow is guided into the fan unit 320. The air flow subsequently passes out of the motor bucket 326, for example through apertures formed in the side wall of the motor bucket 326, and passes through the filter 324. Finally the air flow is exhausted through the outlet holes 328 in the main body 22.

When the outlet duct 30 is in its raised position, the separating apparatus 12 may be removed from the vacuum cleaner 10 for emptying and cleaning. The separating apparatus 12 comprises a handle 340 for facilitating the removal of the separating apparatus 12 from the vacuum cleaner 10. The handle 340 is connected to the cover 188, for example by a snap-fit connection. To empty the separating apparatus 12, the user depresses a button for actuating a mechanism for applying a downward pressure to the uppermost portion of the catch 72 to cause the catch 72 deform and disengage from the groove located on the outer wall 16 of the outer bin 14. This enables the base 18 to move away from the outer wall 16 to allow dirt and dust that has been collected in the dust collectors of the separating apparatus 12 to be emptied into a dustbin or other receptacle. As shown in FIG. 4, the actuating mechanism comprises a push rod mechanism 342 which is slidably located on the outer surface of the separating apparatus 12, and which is urged against the catch 72 to move the catch 72 away from the groove, allowing the base 18 to drop away from the outer wall 16 so that dirt and dust collected within the separating apparatus 12 can be removed.

In this embodiment, the third cyclonic separating unit 78 comprises three sets of third cyclones. Of course, the third cyclonic separating unit 78 may comprises more than three sets of third cyclones, or fewer than three sets of third cyclones. For example, the second set of third cyclones 164 may be omitted so that the third set of third cyclones 166 provides a second set of third cyclones. As another alternative, the first set of second cyclones 162 may be omitted so that the second set of third cyclones 164 provides a first set of third cyclones and the third set of third cyclones 166 provides a second set of third cyclones.

The invention claimed is:

1. A surface treating appliance comprising:

a first cyclonic separating unit including at least one first cyclone;

a second cyclonic separating unit located downstream from the first cyclonic separating unit and including at least one second cyclone; and a third cyclonic separating unit located downstream from the second cyclonic separating unit and including a plurality of third cyclones arranged in parallel about an axis, each third cyclone comprising a fluid inlet and a fluid outlet, the plurality of third cyclones being divided into at least a first set of third cyclones and a second set of third cyclones, the fluid inlets of the first set of third cyclones being arranged in a first group and the fluid inlets of the second set of third cyclones being arranged in a second group spaced along said axis from the first group.

2. The appliance of claim 1, wherein the first group of fluid inlets is generally arranged in a first annular arrangement, and the second group of fluid inlets is generally arranged in a second annular arrangement spaced along said axis from the first annular arrangement.

3. The appliance of claim 1, wherein, within each set, the third cyclones are substantially equidistant from said axis.

4. The appliance of claim 1, wherein each third cyclone has a longitudinal axis, and wherein the longitudinal axes of the cyclones of at least one of the first and second set of third cyclones approach one another.

5. The appliance of claim 4, wherein the angle at which the longitudinal axes of the first set of third cyclones intersect said axis is different from the angle at which the longitudinal axes of the second set of third cyclones intersect said axis.

6. The appliance of claim 1, wherein the first set of third cyclones extends about part of the second set of third cyclones.

7. The appliance of claim 1, wherein the first set of third cyclones is located above at least part of the second set of third cyclones.

8. The appliance of claim 1, wherein the third cyclonic separating unit comprises a third set of third cyclones, the fluid inlets of the third set of third cyclones being arranged in a third group spaced along said axis from the first group and the second group.

9. The appliance of claim 8, wherein the third group of fluid inlets is generally arranged in a third annular arrangement.

10. The appliance of claim 8, wherein the second set of third cyclones extends about at least part of the third set of third cyclones.

11. The appliance of claim 8, wherein the second set of third cyclones is located above at least part of the third set of third cyclones.

12. The appliance of claim 1, wherein each set of third cyclones comprises a respective different number of cyclones.

13. The appliance of claim 1, wherein the second cyclonic separating unit comprises a plurality of second cyclones arranged in parallel wherein the arrangement of the second cyclones about said axis is substantially the same as the arrangement of the first set of third cyclones about said axis.

14. The appliance of claim 13, wherein the plurality of second cyclones is arranged about at least some of the third cyclones.

15. The appliance of claim 13, wherein each second cyclone comprises a flexible portion.

16. The appliance of claim 1, wherein each cyclone of at least the first set of third cyclones comprises a flexible portion.

17. The appliance of claim 1, comprising a vacuum cleaning appliance.

* * * * *